US010132114B2

(12) United States Patent
Siodla et al.

(10) Patent No.: US 10,132,114 B2
(45) Date of Patent: Nov. 20, 2018

(54) SPACER PROFILE AND INSULATING GLASS UNIT COMPRISING SUCH A SPACER

(75) Inventors: Thorsten Siodla, Kassel (DE); Peter Cempulik, Kassel (DE); Joerg Lenz, Kassel (DE)

(73) Assignee: TECHNOFORM GLASS INSULATION HOLDING GMBH, Kassel (DE)

( * ) Notice: Subject to any disclaimer, the term of this patent is extended or adjusted under 35 U.S.C. 154(b) by 1432 days.

(21) Appl. No.: 13/981,371

(22) PCT Filed: Jan. 24, 2012

(86) PCT No.: PCT/EP2012/000385

§ 371 (c)(1),
(2), (4) Date: Jul. 24, 2013

(87) PCT Pub. No.: WO2012/100961

PCT Pub. Date: Aug. 2, 2012

(65) Prior Publication Data

US 2013/0316184 A1 Nov. 28, 2013

(30) Foreign Application Priority Data

Jan. 25, 2011 (DE) ..... 10 2011 009 359

(51) Int. Cl.
*E06B 3/663* (2006.01)

(52) U.S. Cl.
CPC ..... *E06B 3/66361* (2013.01); *E06B 3/66319* (2013.01); *E06B 3/66323* (2013.01);
(Continued)

(58) Field of Classification Search
CPC ..... B32B 5/16; E06B 3/663; E06B 2003/663; E06B 3/66; E06B 3/66309;
(Continued)

(56) References Cited

U.S. PATENT DOCUMENTS 2,094,381 A 9/1937 Slayter
2,235,680 A 3/1941 Haven et al.
(Continued)

FOREIGN PATENT DOCUMENTS

CA 782179 A 4/1968
CA 2269715 5/1998
(Continued)

OTHER PUBLICATIONS

Machine translation (Google patents) of EP 1099038 B1. Translated Jun. 12, 2017.*
(Continued)

*Primary Examiner* — Maria V Ewald
*Assistant Examiner* — Ethan A. Utt
(74) *Attorney, Agent, or Firm* — J-TEK Law PLLC; Jeffrey D. Tekanic; Scott T. Wakeman

(57) ABSTRACT

A spacer profile adapted to be used in a spacer frame of an insulating glass unit includes a hollow profile body made of a first synthetic material and a chamber for accommodating hydroscopic material, the hollow profile body having an inner wall that is, in an assembled state of the insulating glass unit, directed to the intervening space between panes of the insulating glass unit, an outer wall on the opposite side of the inner wall, a first side wall and a second side wall on the opposite side to the first side wall, the walls being connected to form the chamber, and a diffusion barrier portion made of a second synthetic material with sheet silicates and being formed as at least a part of the outer wall.

27 Claims, 6 Drawing Sheets

(52) U.S. Cl.
CPC . *E06B 2003/6638* (2013.01); *Y10T 428/1234* (2015.01); *Y10T 428/24174* (2015.01)

(58) Field of Classification Search
CPC ..... E06B 3/66314; E06B 3/66319; E06B 3/66323; E06B 3/66328; E06B 2003/6638; E06B 2003/66385; E06B 3/66333; E06B 3/66361; E04C 2/54; E04C 2/543
USPC ..... 52/786.13, 786.1; 264/108; 428/34
See application file for complete search history.

(56) References Cited

U.S. PATENT DOCUMENTS 2,525,717 A 10/1950 Ottenheimer
2,741,809 A 4/1956 Englehart et al.
2,838,809 A 6/1958 Zeolla et al.
2,915,793 A 12/1959 Berg
2,934,801 A 5/1960 Blaszkowski
2,974,377 A 3/1961 Kunkle
3,168,089 A 2/1965 Larkin
3,758,996 A 9/1973 Bowser
3,872,198 A 3/1975 Britton
3,998,680 A 12/1976 Flint
4,015,394 A 4/1977 Kessler
4,080,482 A 3/1978 Lacombe
4,131,588 A 12/1978 Smith
4,131,589 A 12/1978 Smith
4,149,348 A 4/1979 Pyzewski
4,222,213 A 9/1980 Kessler
4,407,105 A 10/1983 Frank
4,479,988 A 10/1984 Dawson
4,604,840 A 8/1986 Mondon
4,658,553 A 4/1987 Shinagawa
4,696,857 A 9/1987 Sibilia et al.
4,818,319 A 4/1989 Beer et al.
5,079,054 A 1/1992 Davies
5,125,195 A 6/1992 Brede
5,209,034 A 5/1993 Box
5,290,611 A 3/1994 Taylor
5,302,425 A 4/1994 Taylor
5,313,761 A 5/1994 Leopold
5,313,762 A 5/1994 Guillemet
5,424,111 A * 6/1995 Farbstein ..... E06B 3/66323 52/172
5,439,716 A 8/1995 Larsen
5,460,862 A 10/1995 Roller
5,678,377 A 10/1997 Leopold
5,679,419 A 10/1997 Larsen
5,820,488 A 10/1998 Sullivan et al.
5,851,609 A 12/1998 Baratuci et al.
5,851,627 A 12/1998 Farbstein
5,897,411 A 4/1999 Stark et al.
5,962,090 A 10/1999 Trautz
6,061,994 A 5/2000 Goer
6,108,999 A 8/2000 Smith et al.
6,192,652 B1 2/2001 Goer
6,223,414 B1 5/2001 Hodek et al.
6,250,045 B1 6/2001 Goer et al.
6,339,909 B1 1/2002 Brunnhofer
6,355,328 B1 3/2002 Baratuci
6,389,779 B1 5/2002 Brunnhofer
6,457,294 B1 10/2002 Virnelson
6,537,629 B1 3/2003 Ensinger
6,613,404 B2 9/2003 Johnson
6,796,102 B2 9/2004 Virnelson
6,989,188 B2 1/2006 Brunnhofer
7,078,453 B1 7/2006 Feeney et al.
7,081,300 B2 7/2006 Laurence
7,827,760 B2 11/2010 Brunnhofer et al.
7,913,470 B2 3/2011 Siodla et al.
7,997,037 B2 8/2011 Crandell
8,453,415 B2 6/2013 Brunnhofer et al.
8,640,406 B2 2/2014 Brunnhofer et al.
8,756,879 B2 * 6/2014 Cempulik ..... E06B 3/66319 52/172
2001/0001357 A1 5/2001 Reichert
2003/0037493 A1 2/2003 Guhl et al.
2004/0163347 A1 8/2004 Hodek et al.
2005/0034386 A1 2/2005 Crandell
2005/0100691 A1 5/2005 Bunnhofer et al.
2005/0170180 A1 * 8/2005 Kawa ..... C08K 3/40 428/404
2006/0130427 A1 6/2006 Hodek et al.
2006/0150577 A1 7/2006 Hodek et al.
2006/0162281 A1 7/2006 Pettit
2006/0260227 A1 11/2006 Winfield
2007/0116907 A1 5/2007 Landon et al.
2007/0191526 A1 8/2007 Jordan et al.
2007/0197710 A1 * 8/2007 Wu ..... B32B 27/08 524/445
2007/0261358 A1 11/2007 Davis et al.
2008/0053037 A1 3/2008 Gallagher
2008/0110109 A1 5/2008 Hermens
2008/0134596 A1 6/2008 Brunnhofer et al.
2008/0295451 A1 12/2008 Brunnhofer et al.
2009/0120019 A1 5/2009 Trpkovski
2009/0120035 A1 5/2009 Trpkovski
2009/0246802 A1 10/2009 Langen
2010/0011703 A1 1/2010 Seele et al.
2010/0107526 A1 5/2010 Brunnhofer et al.
2011/0041427 A1 2/2011 Bouesnard
2012/0297707 A1 11/2012 Lenz
2012/0297708 A1 11/2012 Brunnhofer et al.
2013/0164551 A1 6/2013 Daum

FOREIGN PATENT DOCUMENTS

CN 2329746 7/1999
CN 101044292 A 9/2007
CN 101360791 A 2/2009
DE 26 14 236 10/1977
DE 2754795 A1 6/1978
DE 2755283 A1 6/1978
DE 4226883 A 3/1993
DE 43 41 905 6/1994
DE 94 08 764 11/1995
DE 195 30 838 A1 2/1997
DE 196 44 346 4/1998
DE 29814768 U1 1/1999
DE 198 05 265 4/1999
DE 198 05 348 A1 8/1999
DE 198 07 454 A1 8/1999
DE 697 34 014 T2 11/1999
DE 198 32 731 A1 6/2000
DE 10106779 A1 8/2002
DE 10226268 A1 10/2003
DE 20 2005 016 444 U1 3/2006
DE 20 2005 019 973 U1 4/2006
DE 10 2004 062 060 5/2006
DE 69734014 6/2006
DE 202010007972 U1 12/2010
DE 102010006127 A1 8/2011
EP 0 029 984 6/1981
EP 0196493 A2 10/1986
EP 0230160 A1 7/1987
EP 0 601 488 A2 6/1994
EP 0601488 A2 6/1994
EP 0688934 A2 12/1995
EP 0 953 715 A2 11/1999
EP 1 017 923 A1 7/2000
EP 0764739 B1 1/2001
EP 0991815 B1 8/2002
EP 0 953 715 B1 4/2004
EP 1099038 B1 4/2004
EP 1428657 A1 6/2004
EP 1520792 A2 4/2005
EP 1 429 920 B1 5/2005
EP 1 529 920 A2 5/2005
EP 1129270 B1 8/2005
EP 1429920 B1 3/2010
EP 2668361 B1 12/2015
FR 1 475 287 3/1967

(56) References Cited

FOREIGN PATENT DOCUMENTS

| | | | | |
|---|---|---|---|---|
| GB | 1 520 257 | | 8/1978 | |
| GB | 2411201 | A | 8/2005 | |
| GB | 2432179 | A | 5/2007 | |
| JP | 11247540 | H | 9/1999 | |
| JP | 2000319091 | A | 11/2000 | |
| WO | 99/15753 | | 4/1999 | |
| WO | 00/05474 | | 2/2000 | |
| WO | 0005475 | A1 | 2/2000 | |
| WO | WO 0005475 | A1 * | 2/2000 | ..... E06B 3/66323 |
| WO | 0047657 | A1 | 8/2000 | |
| WO | 03/024715 | | 3/2003 | |
| WO | 03087519 | A | 10/2003 | |
| WO | 2004005376 | A2 | 1/2004 | |
| WO | 2006000219 | A1 | 1/2006 | |
| WO | 2006013088 | A1 | 2/2006 | |
| WO | 2006/025953 | A1 | 3/2006 | |
| WO | 2006/027146 | | 3/2006 | |
| WO | 2007140009 | A2 | 12/2007 | |
| WO | 2008141771 | A1 | 11/2008 | |
| WO | WO-2009101166 | A1 * | 8/2009 | ..... E06B 3/66309 |

OTHER PUBLICATIONS

Pauling, Linus. (1970). General Chemistry (3rd Edition)—18.11 The Silicate Minerals. Dover Publications. Online version available at: app.knovel.com/hotlink/pdf/id:kt00AZWDH3/general-chemistry-3rd/silicate-minerals.*

Wypych, George. (2010). Handbook of Fillers (3rd Edition)—2.1. 63 Talc. ChemTec Publishing. Online version available at: app.knovel.com/hotlink/pdf/id:kt007C16H5/handbook-fillers-3rd/talc.*

ANTEC 1997 Plastics: Plastics Saving Planet Earth, vol. 2: Materials—Rheological Behavior and Extrusion Characteristics of Talc-Thermoplastic Compounds (221). Society of Plastics Engineers. PDF available at: app.knovel.com/hotlink/pdf/id:kt003KJTL2/antec-1997-plastics-plastics/rheological-behavior (Year: 1997).*

Written Opinion of the International Searching Authority from PCT/EP2012!000385.

International Search Report from PCT/EP2012/000385.

Applicant's Answer filed Mar. 17, 2017 in Opposition against counterpart European Patent No. 2 668 361.

Office Action from the Chinese Patent Office dated Oct. 10, 2014 in related Chinese application No. 2012800066260.9, and machine translation thereof.

Search report from the Chinese Patent Office dated Sep. 25, 2014 in related Chinese application No. 2012800066260.9.

M. Hosokawa et al., "Nanoparticle Technology Handbook", Elsevier 2007, pp. 458-460.

Notice of Opposition dated Oct. 12, 2016 in counterpart European Patent Application No. 12708668.4, including granted claims subject to Opposition.

Wikipedia page for "Glimmer" in German and corresponding English Wikipedia page.

Wikipedia page for "Schichtsilikate" in German and corresponding English Wikipedia page.

Wikipedia page for "Talk" in German and corresponding English Wikipedia page.

Wikipedia page for "Waermeleitfaehigkeit" in German and corresponding English Wikipedia page.

* cited by examiner

SPACER PROFILE AND INSULATING GLASS UNIT COMPRISING SUCH A SPACER

CROSS-REFERENCE

This application is the U.S. national stage of International Application No. PCT/EP2012/000385 filed on Jan. 24, 2012, which claims priority to German patent application no. 10 2011 009 359.1 filed on Jan. 25, 2011.

TECHNICAL FIELD

The present invention relates to a spacer profile adapted to be used in an insulating glass unit comprising such a spacer profile and further to an insulating glass unit comprising such a spacer profile.

RELATED ART

Insulating glass units having at least two panes 151, 152, which are held at a distance spaced apart from each other in the insulating glass unit are well-known (see FIG. 13). The panes 151, 152 are normally made from an inorganic or organic glass or from other materials such as Plexiglas. Normally, the distance (separation) of the panes 151, 152 is secured by a spacer frame 150 constituted by at least one spacer profile 100 made of a composite material, and layers 161 of bonding material. Spacer profiles made of composite materials, also known as composite spacer profiles, are formed by a synthetic profile being provided with a metal layer as a diffusion barrier, and are known, for example, from EP 0 953 715 A2 (family member U.S. Pat. No. 6,196,652), EP 1 017 923 A1 (family member U.S. Pat. No.6,339,909) or EP 1 529 920 B1 (family member US 2005/0100691 A1).

The intervening space 153 between the panes is preferably filled with an inert insulating gas, e.g. such as argon, krypton, xenon, etc. Naturally, this filling gas should not be permitted to leak out of the intervening space 153 between the panes, also over a long period of time. Moreover, the ambient air or rather components thereof, as for example nitrogen, oxygen, water, etc., also should not be permitted to enter into the intervening space 153 between the panes. Therefore, the spacer profile 100 must be designed so as to prevent such a diffusion between the intervening space 153 of the panes and the ambient. Therefore, spacer profiles comprise a diffusion barrier 157, which prevents a diffusion of the filling gas from the intervening space 153 between the panes to the ambient through the spacer profile 100.

Furthermore, the heat transmission of the edge connection, i.e. the connection of the edge of the insulating glass unit, of the glass panes 151, 152, and of the spacer frame 150, in particular, plays a very large role for achieving low heat conduction of these insulating glass units. Insulating glass units, which ensure high heat insulating along the edge connection, fulfil "warm edge" conditions as this term is utilized in the art. Thus, spacer profiles 100 shall have high heat insulation or low heat conduction.

The spacer frame 150 is preferably bent from a one piece spacer profile 100. In order to close the frame 150, respective ends of the spacer profile 100 are connected by a connector. If the spacer frame 150 is made up of a plurality of pieces of spacer profiles 100, a plurality of connectors is necessary. With respect to manufacturing costs as well as to insulating characteristics, it is preferred to provide only one connection.

Bending of the frame 150 made of the spacer profile 100 is, for example, performed by cold bending (at a room temperature of approximately 20° C.). Thereby, there is a problem of wrinkle formation at the bends.

The spacer profile shall be bendable with a minimum of wrinkle formation and, at the same time, have a high stability or rather rigidity and flexural strength.

A spacer profile is known from EP 0 601 488 A2 (family member U.S. Pat. No. 5,460,862), wherein an additional reinforcement or rather stiffening support is embedded on the side of the profile that faces toward the intervening space between the panes in the assembled state.

Furthermore, spacers comprising a comparatively thin continuous reinforcement layer made of metal material on the profile body made of synthetic material are well known. Such spacers are loosing their diffusion resistance or rather impermeability when being bent about 90° and comprise comparatively thick profile walls made of synthetic material to avoid sagging.

Other spacer profiles are known from DE 697 34 014 T2 (family member U.S. Pat. No. 5,851,609) and WO 2006/025953 A1.

SUMMARY

It is an aspect of the invention to provide an improved spacer profile having improved heat/thermal insulation while, at the same time, having a considerable strength and flexural strength and good wrinkle formation characteristics in a bending process. An insulating glass unit with such a spacer profile is an additional aspect of the invention.

The diffusion resistance (or rather impermeability) is provided by a diffusion barrier. The diffusion barrier is at least partly made of a synthetic material to which sheet silicate is added. The synthetic material with sheet silicate has a heat conductivity being substantially lower than that of the reinforcement (stiffening, strengthening) layers. A spacer profile comprising two separate reinforcement layers, which are connected in a central portion by a diffusion barrier portion made of synthetic material with sheet silicate, has, in comparison to a similar conventional spacer profile, a substantially lower heat conductivity while at the same time having a constant or unchanged diffusion resistance. Furthermore, at the same time, the spacer profile may have a higher rigidity/stiffness and strength than conventional spacer profiles. Furthermore, material for the reinforcement layers can be saved such that the manufacturing costs and weight can be lowered.

BRIEF DESCRIPTION OF THE DRAWINGS

Further features and usabilities follow from the description of exemplary embodiments with consideration of the figures. The figures show in.

DETAILED DESCRIPTION OF THE INVENTION

Subsequently, embodiments are described with reference to FIGS. 3 to 12. The same features/elements are marked with the same reference signs in all figures. Thereby, for the purpose of clarity, all reference signs have not been inserted into all figures.

Figure 3:
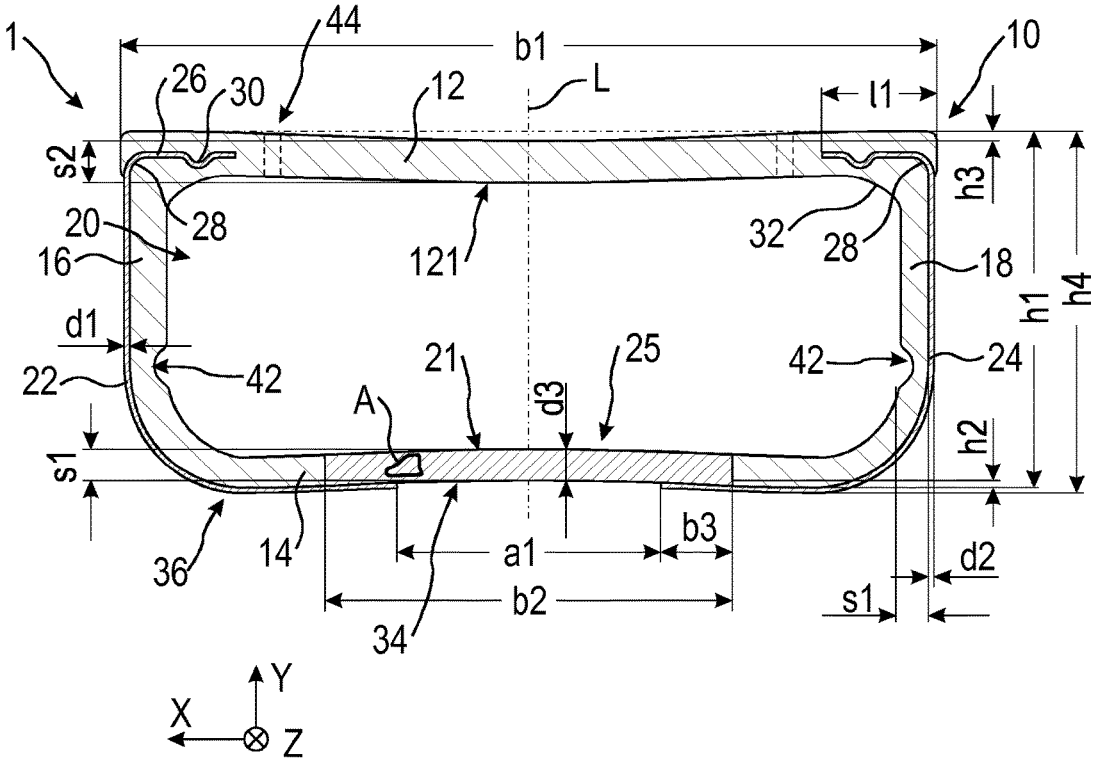

In the following, a spacer profile 1 according to a first embodiment is described with reference to FIGS. 3 and 4. The spacer profile 1 is shown in FIG. 3 in a cross-sectional view perpendicular to the longitudinal direction Z, that means, shown in a cross-sectional view in a X-Y plane, the X-Y plane being spanned by a lateral direction X, which is perpendicular to the longitudinal direction Z, and a height direction Y, which is perpendicular to the lateral direction X and the longitudinal direction Z. The spacer profile 1 extends in this embodiment in the longitudinal direction Z with a plane of symmetry L arranged centrally with respect to the lateral direction X and parallel to the longitudinal direction Z and the height direction Y.

The spacer profile 1 comprises a hollow profile body 10 made of a first synthetic material, the hollow profile body 10 extending with a constant or rather unchanged cross-section in the longitudinal direction Z, and having a first width b1 in the lateral direction X and a first height h1 in the height direction Y. In the height direction Y, the hollow profile body 10 has an inner wall 12 and, in the height direction oppositely to the inner wall 12, an outer wall 14. The outer boundaries or rather edges of the inner wall 12 and the outer wall 14 in the lateral direction X are respectively connected by a side wall 16, 18 extending basically in parallel to the height direction Y. The first side wall 16 is located on the opposite side to the second side wall 18 in the lateral direction X. The plane of symmetry L extends basically parallel to the side walls 16, 18 and is located centrally between the side walls 16, 18. A chamber 20 is formed or rather defined by the inner wall 12, the first side wall 16, the outer wall 14 and the second side wall 18, all of them being connected to each other. Accordingly, in a cross sectional view perpendicular to the longitudinal direction Z, a closed, basically quadrangular profile, basically shaped as a closed "O" and defining the chamber 20 therein, is provided by the above walls. "Closed" does not necessarily mean that no openings are provided in one or more of the walls.

The first side wall 16, the second side wall 18 and the outer wall 14 respectively have a first wall thickness s1. The inner wall 12 has a second wall thickness s2.

Transitions or rather connecting portions of the side walls 16, 18 to the outer wall 14 are respectively round shaped in the first embodiment, here basically in form of a quadrant. Accordingly, a U-form/profile (U-configuration) is provided or rather formed by the two side walls 16, 18 and the outer wall 14, on which the inner wall 12 is placed as a cover. Therefore, the transitions or rather connection portions between the side walls 16, 18 and the inner wall 12, if seen in a cross-sectional view perpendicular to the longitudinal direction Z, basically have a rectangular shape with rounded connection portions on the side facing the chamber 20. The hollow profile body 10 forming the chamber 20 is preferably integrally formed by an extrusion process.

In this embodiment, the outer wall 14 is formed slightly concave with respect to the chamber 20. That means, the outer wall 14 is curved or rather corrugated or bulged in the height direction Y towards the inner space of the chamber 20 to form a curvature or rather convexity or bulge 21. The outer wall 14 is curved inwardly by a second height h2 towards the chamber 20 in the middle with respect to its edges in the lateral direction X, which means in an area of the plane of symmetry L.

In this embodiment, also the inner wall 12 is formed slightly concave with respect to the chamber 20. That means, the inner wall 20 is curved towards the inner space of the chamber 20 in the height direction Y to form a curvature 121. The inner wall 12 is, centrally with respect to its edges in the lateral direction X, which means in an area of the plane of symmetry L, curved by a third height h3 inwardly towards of the chamber 20.

Preferably, the curvatures 21, 121 are already formed in the extrusion process in the synthetic material. However, the curvatures 21 may also be formed directly after the extrusion or rather in a subsequent roll forming process.

Two reinforcement layers 22, 24 are extending directly on the hollow profile body 10 on a main portion of the outer surfaces of the side walls 16, 18 facing away from the chamber 20 and on a portion of the outer surface of the outer wall 14 facing away from the chamber 20, respectively. The first reinforcement layer 22 extends in one piece and continuously in the longitudinal direction Z with a constant cross-section directly on the outer surface (facing away from the chamber 20) of the first side wall 16 from just under the inner wall 12 to and directly on a portion of the outer surface (facing away from the chamber 20) of the outer wall 14 facing the first side wall 16. A second reinforcement layer 24 extends in one piece and continuously in the longitudinal direction Z with a constant cross-section directly on the outer surface (facing away from the chamber) of the second side wall 18 from just under the inner wall 12 to and directly on a portion of the outer surface (facing away from the chamber 20) of the outer wall 14 facing the second side wall 18. That means, the first reinforcement layer 22 extends basically on the "left" side of the outer wall 14 as shown in FIG. 3 while the second reinforcement layer extends basically on the "right" side of the outer wall 14 as shown in FIG. 3. The first reinforcement layer 22 is made of a first diffusion resistant or rather impermeable metal material having a first specific heat conductivity $\lambda_1$ and a first thickness d1. The second reinforcement layer 24 is made of a second diffusion resistant or rather impermeable metal material having a second specific heat conductivity $\lambda_2$ and a second thickness d2.

As far as the term "diffusion resistance", or rather "diffusion resistant" (or (diffusion) impermeability, diffusion proof etc.) are utilized with respect to the spacer profile or materials forming the spacer profile, vapour diffusion impermeability as well as also gas diffusion impermeability for the gases relevant herein (for example nitrogen, oxygen, water, etc.) are meant to be encompassed within the meaning thereof. The utilized materials are considered to be gas or vapour diffusion resistant or rather impermeable, if not more than 1% of the gases in the intervening space 153 between the panes can leak out within the period of one year. Furthermore, diffusion resistant is also equated to a low permeability in the sense of that the corresponding test norm EN1279 part 2+3 is fulfilled. That means, the finished spacer profile or insulating glass unit (or insulating window unit) having such a spacer profile has to fulfil the test norm EN1279 part 2+3.

The first and second reinforcement layers 22, 24 do not contact with each other. The reinforcement layers 22, 24 are formed and arranged such that they are spaced (apart) by a first distance al with respect to the lateral direction X. That means, a central portion 25 located centrally with respect to the lateral direction X is provided between the reinforcement layers 22, 24, wherein in or rather on the central portion 25 no reinforcement layers 22, 24 are provided. The central portion 25 extends over the first distance al in the lateral direction X and in the longitudinal direction Z.

In this embodiment, the reinforcement layers 22, 24 extend symmetrically with respect to the plane of symmetry L such that the first reinforcement layer 22 and the second reinforcement layer 24 are arranged on the outer wall 14 spaced with a distance a1/2 to the plane of symmetry L, respectively. The reinforcement layers 22, 24 are directly materially connected to the respective walls. That means, in this embodiment, the hollow profile body 10 and the reinforcement layers 22, 24 are coupled permanently by, for example, co-extruding the hollow profile body 10 together with the reinforcement layers 22, 24 and/or, where appropriate, by utilizing an adhesion promoter, and no further layers are formed between the reinforcement layers 22, 24 and the hollow profile body 10.

The first reinforcement layer 22 has a first constant thickness d1. The second reinforcement layer 24 has a second constant thickness d2. The first thickness d1 and the second thickness d2 are the same, in the present embodiment. As the reinforcement layers 22, 24 are formed on the outer surface (or rather side) of the outer wall 14, respectively, the height of the spacer profile 1 in the height direction Y consists basically of the first height h1 of the hollow profile body 10 and the amount of the first or second thickness (d1 or rather d2), such that the spacer profile 1 has an entire height (h4=h1+d1), in this embodiment. The width of the spacer profile 1 corresponds to the first width b1 of the hollow profile body 10, because the hollow profile body 10 is formed at the boundaries or edges in the lateral direction X such that the reinforcement layers 22, 24 do not increase the first width b1, in this embodiment. That means, the portion of the side walls 16, 18, on which no reinforcement layers 22, 24 are provided, are correspondingly thicker or rather broader than the portions of the side walls 16, 18, on which the reinforcement layers 22, 24 are provided. Accordingly, the reinforcement layers 22, 24 are, at least partly embedded in the side walls 16, 18 or the edges of the inner wall 12 in the lateral direction X.

The reinforcement layers 22, 24 comprise profiled extension (or rather elongation) portions 26 on their end portions in the height direction Y opposite to the outer wall 14, the extension portions 26 extending in the longitudinal direction Z. The extension portions elongate or rather prolongate or extend the reinforcement layers 22, 24 in the height direction Y from just under the inner wall 12. In this context, the term "profiled" means that the extension portion 26 is not exclusively a linear extension or elongation of the respective reinforcement layer 22, 24 in the height direction Y but instead a two-dimensional profile is formed in the two-dimensional view of the cross-section in the X-Y plane, which profile is formed, for example, by one or more bends or rather curves or angles 28 of the extension portion 26.

In this embodiment, the extension portions 26 have a 90° curve/bend 28 toward the plane of symmetry L into the inner wall 12 at the height of the inner wall 12, respectively. That means, the extension portions 26 extend into the inner wall 12. The extension portions 26 further comprise a groove 30, as it can be seen in the two-dimensional view of the cross-section in the X-Y plane. The extension portion 26 extends with a first length 11 in the lateral direction X from the outer side of the respective side walls 16, 18 of the hollow profile body 10 into the inner wall 12.

By the extension portions 26, an improved bending characteristic and an improved adhesion or bonding of the reinforcement layers 22, 24 on or rather in the hollow profile body 10 is provided. It is preferred that the extension portions 26 are located as close as possible to the outer side of the inner wall 12 facing away from the chamber 20 (as close as possible to the intervening space 53 between the panes) but still being covered by material of the inner wall 12. The extension portions 26 are respectively accommodated in accommodation or retaining portions 32. Each accommodation portion 32 is formed by the inner wall 12 and/or the corresponding side wall 16, 18 and extends from the outer side/surface of the inner wall 12 in the same and, if applicable, in the corresponding side wall 16, 18 over a height in the height direction Y being less than 0,4 h1, preferably less than 0,2 h1 and more preferably less than 0,1 h1. The above mentioned height of the accommodation portions 32 further defines the beginning of the extension portions 26. The accommodation portions 32 have at least the wall thickness s1 of the side walls 16, 18 in the lateral direction X. Preferably, the accommodation portions 32 extend from the outer surfaces of the side walls 16, 18 facing away from the chamber 20 over a width <1,5 l1, preferably over a width <1,2 l1, and more preferred over a width of 1,1 l1 in the lateral direction X, respectively.

The mass (weight) of the respective extension portion 26 comprises preferably at least 10% of the mass (weight) of the remaining part of the respective reinforcement layer 22, 24, which is above the middle line of the spacer profile 1 in the height direction Y, preferably at least about 20%, more preferably at least about 50%, and still more preferably about 100%.

The outer wall 14 is formed by a second synthetic or plastic material to which sheet silicate is added, at least in the portion having no reinforcement layer 22, 24 attached thereon, that means in the central portion 25 located centrally with respect to the lateral direction X and extending over the first distance al in the lateral direction X. As it will be explained in detail below, the second synthetic material to which sheet silicate is added ("synthetic material with sheet silicate") constitutes a diffusion barrier portion 34 being diffusion resistant or rather impermeable with respect to the chamber 20 and the outer side of the outer wall 14 facing away from the chamber 20. Thus, the diffusion barrier portion 34 is diffusion resistant or rather diffusion impermeable, at least in a direction perpendicular to the outer wall 14. The diffusion barrier portion 34 made of the second synthetic material with sheet silicate has a third specific heat conductivity $\lambda_3$ and a third thickness d3 in the height direction Y. In this embodiment, the third thickness d3 equals the first wall thickness s1 of the outer wall 14 because the entire outer wall 14 is made of the synthetic material with sheet silicate in the central portion 25.

In this embodiment, the diffusion barrier portion 34 is connected to the first reinforcement layer 22 and the second reinforcement layer 24 in a diffusion resistant manner to constitute or rather form a continuous diffusion barrier 36. In this embodiment, the diffusion barrier portion 34 extends centrally between the side walls 16, 18 in the lateral direction X with a second width b2 being larger than the first distance a1 between the reinforcement layers 22, 24. That means, the boundary or rather edge of the first reinforcement layer 22 facing the second reinforcement layer 24 overlaps over a third width b3 in the lateral direction X with the boundary or edge of the diffusion barrier portion 34 facing the first reinforcement layer 22. In almost the same manner, the boundary of the second reinforcement layer 24 facing the first reinforcement layer 22 overlaps over the third width b3 in the lateral direction X with the boundary of the diffusion barrier portion 34 facing the second reinforcement layer 24. Accordingly, it is ensured that the reinforcement layers 22, 24 (and its edges on the outer wall 14) are connected to the diffusion barrier portion 34 in a diffusion resistant manner, respectively.

The diffusion barrier portion 34 serves to connect the first reinforcement layer 22 with the second reinforcement layer 24 in a diffusion resistant manner. At the same time, the diffusion barrier portion 34 serves to thermically insulate the first reinforcement layer 22 from the second reinforcement layer 24. The heat conduction through the diffusion barrier portion 34 is lower than through the reinforcement layers 22, 24. The heat conduction, that means the heat conductivity, is dependent on the geometry and the specific heat conductivity of the component/element. The diffusion barrier portion 34 is preferably formed or rather designed such that the (mathematical) product of the third thickness d3 and the third specific heat conductivity $\lambda_3$ of the diffusion barrier portion 34 is smaller than the product of the first thickness d1 with the first specific heat conductivity $\lambda_1$ of the first reinforcement layer 22 as well as smaller than the product of the second thickness d2 and the second specific heat conductivity $\lambda_2$ of the second reinforcement layer 24. This requirement does not exclude that the third specific heat conductivity $\lambda_3$ or the third thickness d3 may be larger than the corresponding parameter of the reinforcement layers 22, 24.

Accordingly, the spacer profile 1 comprises a diffusion resistant and, at the same time, insulating diffusion barrier 36, the diffusion barrier 36 being constituted or rather formed by the first reinforcement layer 22, the diffusion barrier portion 34, and in the second reinforcement layer 24, and extending from the first side wall 16 over the outer wall 14 to the second side wall 18. Therefore, in an assembled state of the spacer profile 1, the intervening space 53 between the panes can be diffusion impermeably bounded or rather defined by the spacer profile 1.

The sheet silicate is provided in the synthetic material in form of sheet silicate lamellas or rather laminas 38. Each of the sheet silicate lamellas 38 is diffusion resistant or rather diffusion impermeable. The sheet silicate lamellas 38 are embedded in the synthetic material of the diffusion barrier portion 34. The sheet silicate lamellas 38 are aligned or rather oriented such that the flat side of each sheet silicate lamella 38 is arranged basically parallel to the outer wall 14. Thereby, the sheet silicate lamellas 38 are basically (at least statistically) distributed in the diffusion barrier portion 34 uniformly in the height direction Y, in the lateral direction X, and in the longitudinal direction Z.

Liquids or gases or rather their atoms or molecules diffuse with specific (diffusion) speeds through synthetic materials. Therefore, when forming the diffusion barrier portion out of a conventional synthetic material without sheet silicate, as it is used, for example, in the present embodiment, for the side walls 16, 18, a specific number of atoms/molecules can diffuse per unit time per wall surface area. By providing sheet silicate lamellas 38 and by orienting or rather aligning the sheet silicate lamellas 38 in the synthetic material parallel to the outer wall 14, the atoms/molecules cannot diffuse through the diffusion barrier portion 34 on a straight line perpendicular to the outer wall, e.g. not on a direct way. In fact, the atoms/molecules are constrained or rather have to circle the respective sheet silicate lamellas 38 arranged perpendicular to the direct way through the outer wall 14. Therefore, the distance which has to be travelled by the atoms/molecules for passing through the diffusion barrier portion 34 in the height direction Y is substantially elongated. Due to the substantially longer travel distance, substantially less molecules per unit time are diffusing through the diffusion barrier portion 34 made of synthetic material with sheet silicate. Thus, the above-defined diffusion resistance or rather diffusion impermeability is achieved.

Figure 4:
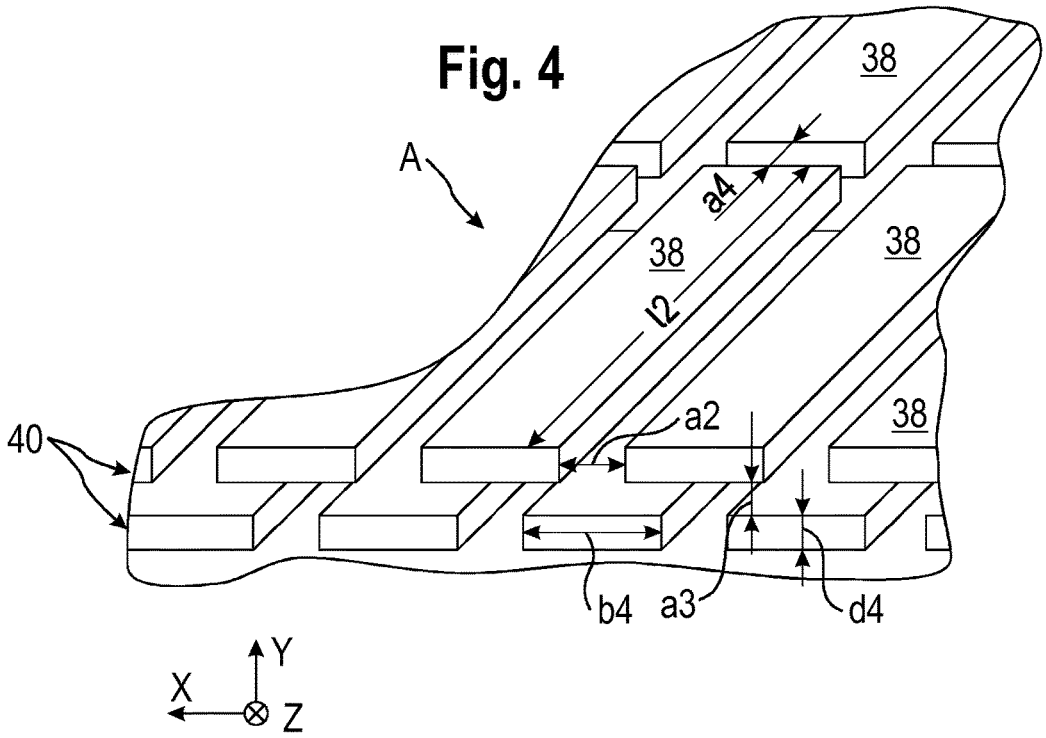

FIG. 4 is an exemplary, idealized and simplified illustration of a detail of the diffusion barrier portion 34. The uniform arrangement of the sheet silicate lamellas as shown in FIG. 4 is idealized. In fact, the arrangement of the sheet silicate lamellas 38 is not uniformly to this extent. Furthermore, in fact, the sheet silicate lamellas 38 have a form basically corresponding to a "lamella". Furthermore, in practice, the sheet silicate lamellas 38 are arranged parallel to the outer wall 14 only basically.

Each of the sheet silicate lamellas 38 has a fourth width b4 in the lateral direction X, a fourth thickness d4 in the height direction Y, and a second length l2 in the longitudinal direction Z. Each sheet silicate lamella 38 is spaced by a second distance a2 in the lateral direction X, a third distance a3 in the height direction Y, and a fourth distance a4 in the longitudinal direction Z to the adjacent sheet silicate lamella 38, respectively. The sheet silicate lamellas 38 are arranged in different sheet planes (or rather sheet layers or layer planes or layer levels) 40 being parallel to the X-Z plane. That means, a plurality of planes (sheet planes 40) of sheet silicate lamellas 38 are laying upon another in the height direction Y. The sheet silicate lamellas 38 in each sheet plane 40 are offset in the lateral direction X to the sheet silicate lamellas 38 in the respective adjacent sheet planes 40, respectively. Preferably, the sheet silicate lamellas 38 of adjacent sheet planes 40 are offset by (a2)/2+(b4)/2 in the lateral direction X, respectively. That means, the displacement (offset) is preferably selected such that when projecting the second distance a2 between two sheet silicate lamellas 38 onto a sheet silicate lamella 38 in an adjacent sheet plane 40, the projection of second distance a2 is arranged centrally on the sheet silicate lamella 38 in the adjacent sheet plane 40, respectively.

Because of the parallel but offset arrangement of the sheet planes, as described above, the molecules cannot "migrate" or rather diffuse straight or rather on the direct way in the height direction Y through the diffusion barrier portion 34. The atoms/molecules moving in the height direction Y through the diffusion barrier portion 34 have to traverse the diffusion barrier portion 34 mazelike or rather in form of a labyrinth. When the atoms/molecules have passed two sheet silicate lamellas 38 in one plane (through the space having the second distance a2 between two adjacent sheet silicate lamellas 38 in one sheet plane 40), each atom/molecule has further to travel a distance (for example (b4)/2) in the lateral direction X before being able to pass through the next two adjacent sheet silicate lamellas 38 in the proximate adjacent sheet plane 40 in the height direction Y. With other words, the atoms/molecules diffusing in the height direction Y through the diffusion barrier portion 34 have to travel through the synthetic material of the diffusion barrier portion 34 for permeating the diffusion barrier portion 34 on a way substantially longer than the direct way with the length of the third thickness d3. The diffusion resistance according to the above-stated definition is achieved by the elongated travel distance and, thus, elongated time required for an atom/molecule for traversing or rather diffusing through the diffusion barrier portion 34.

Due to the overlapping of the reinforcement layers 22, 24 with the diffusion barrier portion 34 in the lateral direction X, it is ensured that the atoms/molecules cannot diffuse through the spacer profile 1 without the desired elongation of the travel through distance. The atoms/molecules may diffuse through the outer wall in the portion, in which no sheet silicate is provided, but afterwards, due to the diffusion resistant reinforcement layers 22, 24, they have to diffuse or travel through the diffusion barrier portion 34 at least over the third thickness b3 in the lateral direction X. The travel distance in the lateral direction X is also elongated, because the sheet silicate lamellas 38 are arranged only basically parallel to the outer wall 14.

As shown in FIG. 3, the side walls 16, 18 comprise a notch 42 on the inner side of the respective side wall 16, 18 facing to the chamber 20, respectively. The notches 42 are formed below the middle line of the spacer profile 1 in the height direction Y and extend in the longitudinal direction Z. The notches 42 provide an improved bending characteristic, as it will be explained below. The notches 42 are preferably formed in the extrusion process.

Openings 44 are formed in the inner wall 12 such that the inner wall 12 is not diffusion resistant, independently of the selected materials for the hollow profile body 10. Thus, in an assembled state, a gas exchange, in particular also a moisture or vapour exchange, between the intervening space 53 of the panes and the chamber 20 filled with hygroscopic material is ensured.

Figure 1:
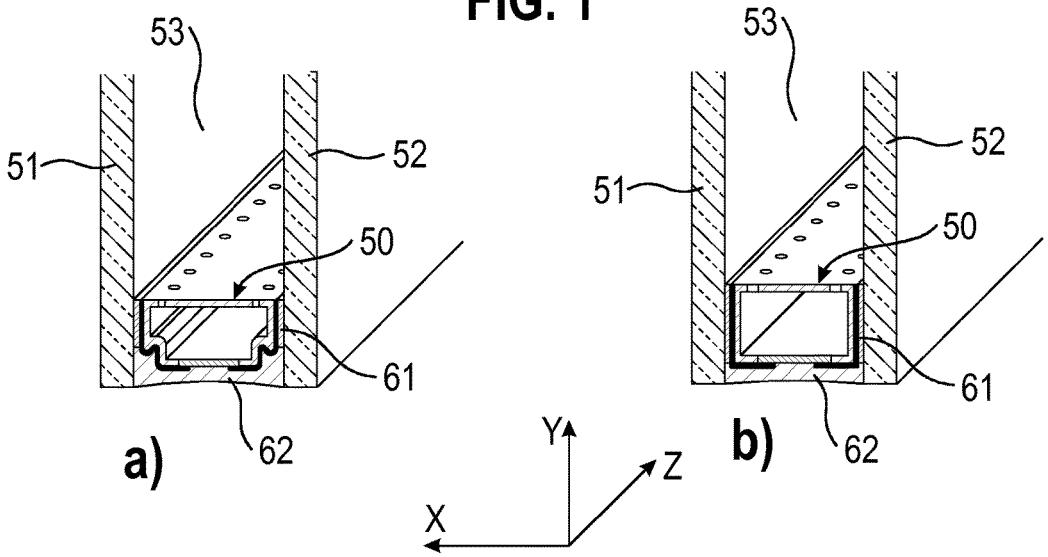
FIG. 1 in a) and b), respectively, a perspective cross-sectional view of an assembled insulating glass unit having with a spacer profile, bonding material and sealing material arranged therebetween, FIG. 2 a partially cross-sectioned schematic side view of a spacer frame in an ideal condition, bent of a spacer profile, FIG. 3 a cross-sectional view of the spacer profile according to a first embodiment in a U-configuration, FIG. 4 an idealized, enlarged, partially cross-sectioned and perspective view of detail "A" of the diffusion barrier portion in FIG.3, FIG. 5 a cross-sectional view of a spacer profile according to a second embodiment in a W-configuration, FIG. 6 a cross-sectional view of a spacer profile according to a third embodiment in a U-configuration, FIG. 7 a cross-sectional view of a spacer profile according to a fourth and fifth embodiment in a U-configuration, FIG. 8 a cross-sectional view of a spacer profile according to a sixth embodiment in a U-configuration, FIG. 9 a cross-sectional view of a spacer profile, in a) in a W-configuration according to a seventh embodiment, and in b) in a U-configuration according to a eighth embodiment, FIG. 10 a cross-sectional view of a spacer profile, in a) in a W-configuration according to a ninth embodiment, and in b) in a U-configuration according to a tenth embodiment, FIG. 11 a cross-sectional view of a spacer profile, in a) in a W-configuration according to a eleventh embodiment, and in b) in a U-configuration according to a twelfth embodiment, FIG. 12 a cross-sectional view of the spacer profile according to the first embodiment after a bending process, and FIG. 13 in a) and b) respectively a perspective cross-sectional view of an assembled insulating glass unit having a spacer profile, bonding material and sealing material therebetween, as it is known from the prior art.

The inner wall 12 is denoted as inner wall because it is directed inwardly to the intervening space 53 between the panes in the assembled state of the spacer profile 1 (see FIG. 1*a*) and *b*)). The outer wall 14 is denoted as outer wall because it is facing away from the intervening space 53 between the panes in the assembled state of the spacer profile 1. The side walls 16, 18 are formed as contact bridges adapted to be in contact with the inner sides of the panes 51, 52, the spacer profile 1 preferably being bonded with the inner sides of the panes by the side walls 16, 18 (see also FIG. 1). The chamber 20 is formed for reception of hygroscopic material.

The spacer profile 1 is preferably bended to a one piece spacer frame 50 (see FIG. 2) by four 90° bends. Alternatively, one, two or three bends can be provided and the remaining 90° corner(s) may be provided by corner connectors. The spacer profiles are preferably bended in a guided cold bending process. For example, the spacer profile 1 is inserted into a groove guiding or rather supporting the side walls in the lateral direction X in the bending process. The groove ensures that the side walls cannot yield outwardly in the lateral direction X in the bending process.

The reinforcement layers 22, 24 and the diffusion barrier portion 34, and, in particular, their thicknesses d1, d2, d3 are designed such that the spacer profile 10 does not rip up or burst in the above bending process of the spacer profile 10. Therefore, the diffusion barrier 36 made of the first reinforcement layer 22, the diffusion barrier portion 34 and the second reinforcement layer 24 remains diffusion resistant also after the bending process.

When bending the spacer profile 1, the inner wall 12 is normally compressed or rather shortened. The outer wall 14 is stretched. A neutral zone is provided between the inner wall 12 and the outer wall 14, the material of the body in the neutral zone being neither stretched nor compressed. The neutral zone is also referred to as "neutral fibre" of a body.

Figure 12:
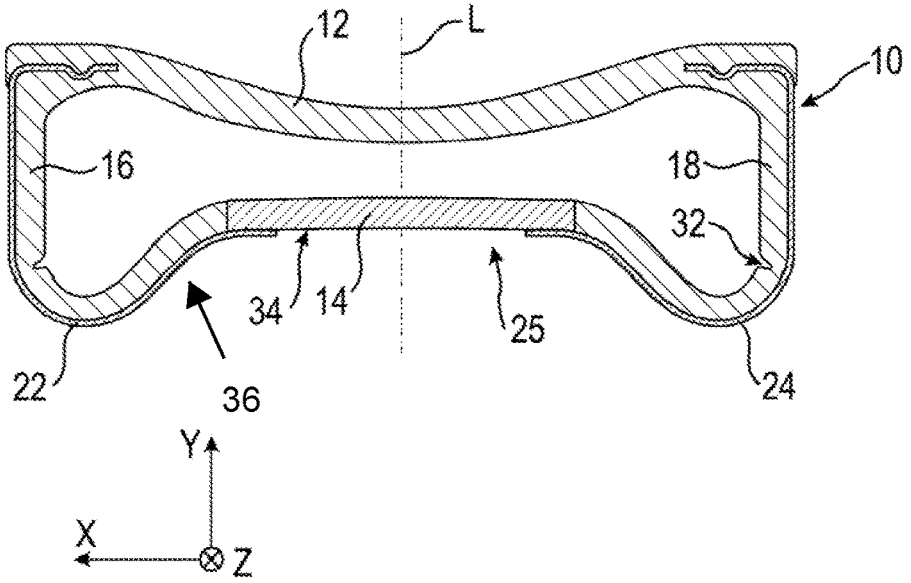
Figure 13:
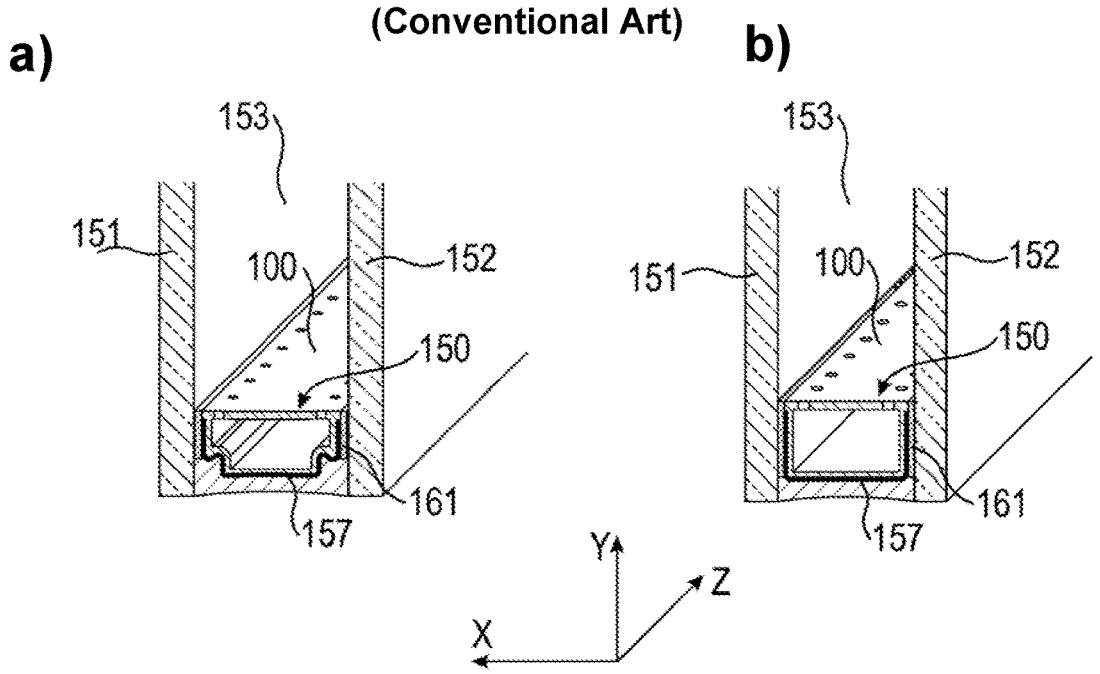
FIG. 13 (Conventional Art)

In this embodiment, the curved or rather bulged design of the outer wall 14 ensures that, in the guided bending process of the spacer profile 1, the outer wall 14 "retracts" or rather "folds" inwardly (see FIG. 12). Here, "retracting" means that the outer wall 14 is offset or displaced towards the chamber 20, e.g. towards the neutral fibre. Additionally, the notches 42 in the side walls 16, 18 may help to easily and fully retract the outer wall 14 inwardly when bending the spacer profile 1.

In order to avoid tearing or rather breaking of the diffusion barrier portion 34 due to an outstanding strong elongation or rather extension in the process of bending, the central portion 25 or rather the diffusion barrier portion 34 extending over the first distance al (portion of the outer wall 14, on which no reinforcement layer 22, 24 is provided) or rather the second distance b2 in the lateral direction X, the curvature 21 of the outer wall 14, that means the second height h2, the first and second wall thickness d1, d2 of the reinforcement layers 22, 24, the wall thicknesses s1, s2 of the chamber 20, and the notches 42 may be formed or designed such that the diffusion barrier portion 34 is arranged adjacent to or on the "neutral fibre" of the spacer profile 1 while or when performing the bending process up to 90° around the bending axes parallel to the lateral direction X. In this case, the diffusion barrier portion 34 is less stressed because no extension or compression occurs in the neutral fibre itself and the bending stress therein is nearly zero.

The curved design of the inner wall 12 also allows an "easy" retraction. The inner wall 12 is mainly compressed. Alternatively or additionally, wrinkle formation may occur such that the length is shortened correspondingly. The extension portions 26 reduce the wrinkle formation at the boundaries in the lateral direction X.

The first metal material of the first reinforcement layer is preferably a plastic deformable material. The term "plastic deformable" means that elastic restoring forces are nearly zero after the deformation. This is typically the case, for example, when metals are bent beyond their elastic limit (apparent yield limit). The preferred first metal material for the first reinforcement layer 22 is steel or stainless steel having a first specific heat conductivity in the range of 10 W/(mK)$\leq\lambda_1\leq$50 W/(mK), preferably in a range between 10 W/(mK)$\leq\lambda_1\leq$25 W/(mK) and more preferably in a range between 10 W/(mK)$\leq\lambda_1\leq$17 W/(mK). The E-modulus of the material is preferably in a range between 170 kN/mm$^2$ to 240 kN/mm$^2$, preferably about 210 kN/mm$^2$. The percent elongation of failure of the material is preferably ≥15%, more preferably ≥20%, and still more preferably ≥30% and still more preferably ≥40%. The metal material may have a corrosion protection of tin (such as tin plating) or zinc, if applicable, necessary or desired, with a chrome coating or chromate coating. The second metal material of the second reinforcement layer 24 preferably corresponds to the first metal material but the second material may also be different to the first metal material, in particular, if the design and thicknesses of the two reinforcement layers 22, 24 are different to each other. An exemplary material for the reinforcement layers 22, 24 is a stainless steel film having a thickness d1, d2 of 0,1 mm.

The first synthetic material for parts of the hollow profile body 10, in which no sheet silicate is provided, is preferably an elastic-plastic deformable, poor heat conducting (and, therefore, insulating) material.

Herein, the term "elastic-plastic deformable" preferably means that elastic restoring forces are active in the material after a bending process, as it is typically the case for synthetic materials. Further, the term "poor heat conducting" preferably means that the heat conductivity (heat conduction value) $\lambda$ is less than or equal to about 0,5 W/(mK), preferably less than or equal to 0,3 W/(mK).

The first synthetic material may be a polyolefin, preferably a polypropylene, or a polyethylene terephthalate, polyamide or polycarbonate, ABS, SAN, PCABS, PVC. An example for such a polypropylene material is Novolen 1040®. The material has an E-modulus preferably being less than or equal to about 2200 N/mm$^2$ and a preferred specific heat conductivity $\lambda \leq 0{,}3$ W/(mK), more preferably $\leq 0{,}2$ W/(mK).

The diffusion barrier portion 34 is made of a second synthetic material with sheet silicate. The second synthetic material is likewise an elastic plastic deformable, poor heat conducting (insulating) material. To produce the second synthetic material with sheet silicate, sheet silicate is added to a synthetic basic material. The synthetic basic material, that means the material to which sheet silicate is added, may be made out of one or a mixture of the materials that are mentioned with respect to the first synthetic material. Preferably, polypropylene is used. In this embodiment, the basic material corresponds to the first synthetic material.

After providing sheet silicate lamellas 38 in the above-mentioned synthetic basic material, the "second synthetic material with sheet silicate" (consisting of the synthetic basic material and sheet silicate) has a third specific heat conductivity $\lambda_3$ being preferably lower than or equal to 0,5 W/(mK), more preferably lower than 0,4 W/(mK), and still more preferably lower than 0,3 W/(mK).

The surface of each sheet silicate lamella 38 has preferably an average value of 0,2 μm$^2$ to 50 μm$^2$, preferably 1 μm$^2$ to 50 μm$^2$ and more preferably 5 μm$^2$ to 50 μm$^2$.

The loading or rather weighting agent of the sheet silicate in the synthetic basic material is between 2% to 50%, preferably between 5% to 30%, and more preferably between 5% and 10%. The sheet silicate lamellas 38 are preferably basically glass silicates. However, also other sheet silicate lamellas may be used.

For manufacturing the spacer profile 1, more than one extruder is used, preferably. In the manufacturing process, the material for the parts or rather components of the hollow profile body 10 not constituting the diffusion barrier portion 34 are formed by a first extruder, and the material for the parts or rather components of the hollow profile body 10 being the diffusion barrier portion 34 are formed by a second extruder.

The raw material for the sheet silicate lamellas 38 consists of staples of individual or separate sheet silicate lamellas (sheet silicate laminas) 38. The staples of sheet silicate lamellas 38 are added to the synthetic basic material of the second synthetic material with sheet silicate in a known manner before filling the second synthetic material with sheet silicate into the second extruder or, alternatively, the sheet silicate lamellas 38 are added to the second synthetic basic material in the second extruder itself The sheet silicate lamellas 38 are most likely oriented erratically after the admixture.

Accordingly, in a further step, the sheet silicate lamellas 38 in the synthetic material with sheet silicate have to be oriented or aligned such that they are oriented basically in parallel to each other and the outer wall 14, as stated above. For this purpose, a laminar flow is generated at a narrow portion upstream of the extruder die by which the diffusion barrier portion 34 is extruded. The narrow portion is preferably designed in form of a slit. Due to the slit, the synthetic material—sheet silicate—mixture is accelerated. Due to the acceleration before and at the narrow portion (slit) and due to the laminar flow in the narrow portion, the sheet silicate lamellas 38 are oriented or aligned parallel to the slit.

The extruded synthetic profile parts or components with and without sheet silicate are preferably connected before they completely cure or rather solidify such that an integral hollow profile body 10 is formed wherein the sheet silicate lamellas 38 in the diffusion barrier portion 34 are arranged parallel to the outer wall 14.

Furthermore, preferably the first and second reinforcement layers 22, 24 are co-extruded together with the hollow profile body 10. In this case, after the extrusion process, the first and second reinforcement layers 22, 24 are materially and directly connected with the hollow profile body, and thus, also with the diffusion barrier portion 34. After applying the reinforcement layers 22, 24, the first reinforcement layer 22, the diffusion barrier portion 34 and the second reinforcement layer 24 constitute a continuous diffusion barrier 36.

Figure 2:
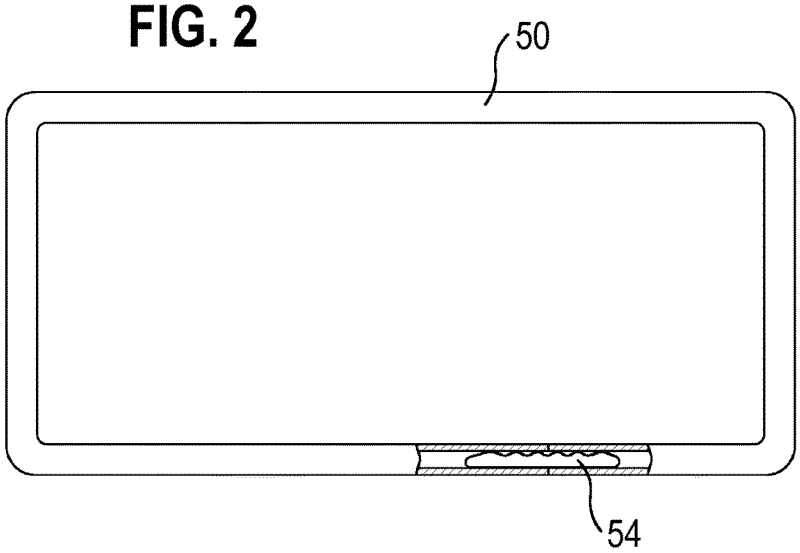

After the extrusion process of the spacer profile 1, the spacer profile 1 is bent in accordance with the form of the desired spacer frame 50, as exemplarily illustrated in FIG. 2. As described above, the side walls 16, 18 are preferably guided in the bending process such that they are not allowed to yield in the lateral direction X in the bending process. After the bending process of the spacer frame 50, the respective ends of the spacer profile 1 have to be connected by an appropriate connector 54 (see FIG. 2). After connecting the (ends of the) spacer profile 1, the side walls 16, 18, which are provided as contacting bridges, are bonded to the inner surfaces of the panes 51, 52 by a bonding material (primary sealing material) 61, which is, for example, a butyl sealing material based on polyisobutylene (see FIG. 1). Accordingly, the intervening space 53 between the panes is defined by the panes 51, 52 and the spacer frame 50. The inner side/surface of the spacer frame 50 faces towards the intervening space 53 of the panes. On the side, facing in FIG. 1 in the height direction Y away from the intervening space 53 of the panes, a mechanically stabilizing sealing material 62 (secondary sealing material), for example based on polysulfide, polyurethane or silicon, is placed in the remaining clearance between the inner sides of the panes to fill up the clearance. This sealing material also protects the diffusion barrier 36 from mechanical and other corrosive/degrading influences. The insulating glass unit (insulating window unit) manufactured as stated above can be mounted into a glass frame, afterwards.

All details concerning the first embodiment also apply to all the other described embodiments, except when a difference is expressly noted or is shown in the figures.

Figure 5:
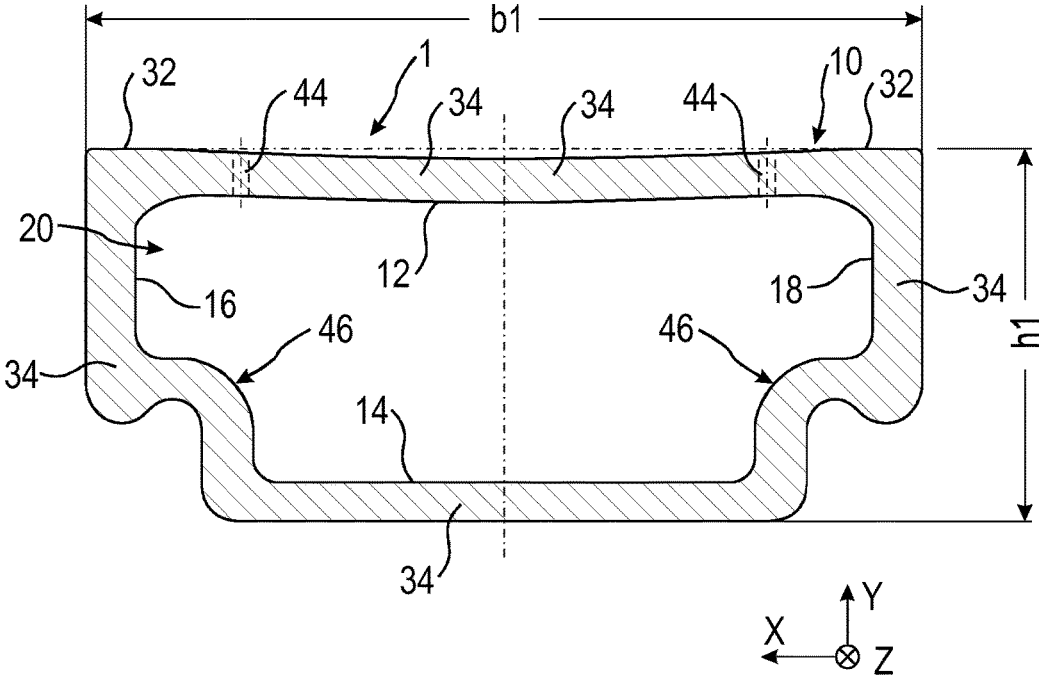

FIG. 5 shows a spacer profile 1 according to a second embodiment. The second embodiment differs from the first embodiment in that no reinforcement layers 22, 24 are provided on the hollow profile body 10 and no extension portions 26 are provided in the hollow profile body 10, but the complete hollow profile body 10 is formed as the diffusion barrier portion 34 made of synthetic material with sheet silicate (which corresponds to the second synthetic material of the first embodiment, here). That means, the outer wall 14, the side walls 16, 18, and the inner wall 12 are formed as the diffusion barrier portion 34 made of the preferably one synthetic material with sheet silicate. In other words, all parts or portions made of the first synthetic material in the first embodiment are also made of the second synthetic material with sheet silicate. That means, in this embodiment, the first synthetic material corresponds to the second synthetic material with sheet silicate such that the complete hollow profile body 10 is made of synthetic material with sheet silicate. Furthermore, the spacer profile 1 is formed in a so-called W-configuration. In the W-configuration, each side wall 16, 18 comprises, if seen from inside the chamber 20, a concave connection portion 46 (here also made of synthetic material with sheet silicate) to the outer wall 14.

In this embodiment, the diffusion barrier 36 is made of a diffusion barrier portion 34, only. Each sheet silicate lamella 38 in the side walls 16, 18 and in the inner wall 12 is preferably oriented basically parallel to the outer wall but may alternatively be oriented basically parallel to the respective wall in which the sheet silicate lamella 38 is arranged. In the concave connection portion 46, the sheet silicate lamellas 38 are formed parallel to the concave connection portions, respectively.

Only one extruder is required for manufacturing the spacer profile 1 according to the second embodiment.

In order to further allow a gas exchange between the chamber filled with hygroscopic material and the intervening space 58 between the panes, also in this embodiment, the inner wall 12 preferably comprises openings 44. Therefore, the diffusion resistance is provided or rather ensured by the sidewalls 16, 18 and the outer wall 14, only.

The concave connection portion 46 extends the "heat conducting path" between the side walls 16, 18 over the outer wall 14, while at the same time, the first width b1 and the first height h1 of the spacer profile 1 are not changed. Furthermore, the bending characteristics of the spacer profile 1 may be improved by such connection portions 40. Furthermore, although the reinforcement layers 22, 24 have been omitted, the required or rather necessary flexural strength is provided by the sheet silicate in the synthetic material of the side walls 16, 18, the inner wall 12, and the outer wall 14, in such an embodiment.

Furthermore, in the spacer profile 1 according to the second embodiment, no curvature 21 in the outer wall is provided.

Figure 6:
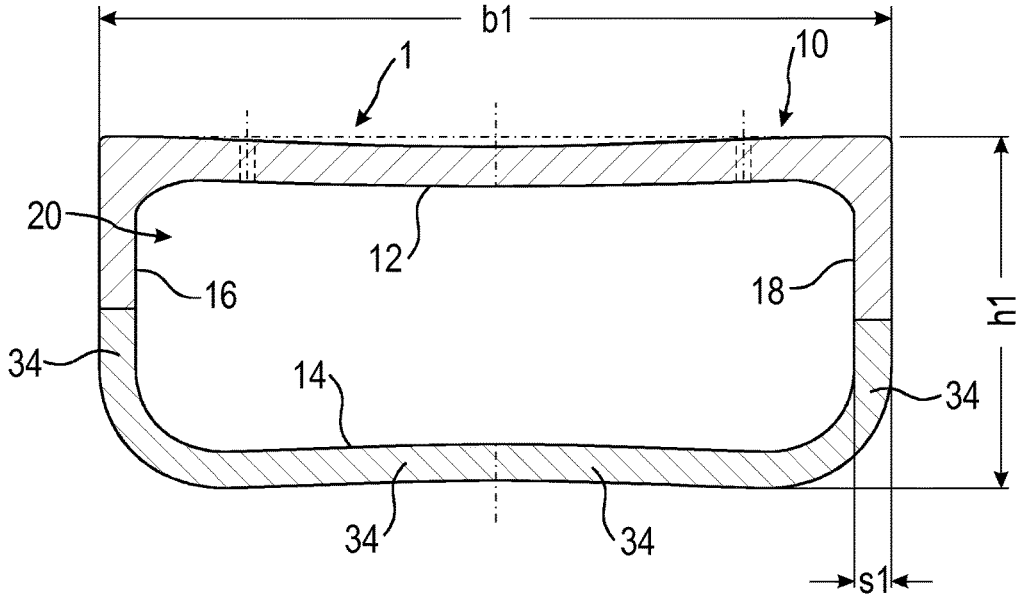

FIG. 6 shows a spacer profile 1 according to a third embodiment. The third embodiment differs from the second embodiment in that the spacer profile 1 is formed in a U-configuration, again, and in that the diffusion barrier portion 34 is not formed in the inner wall 12 and not completely formed in the side walls 16, 18. In this embodiment, the diffusion barrier portion 34 is completely formed in the outer wall 14 and formed up to a height of about (h1)/2 from the outer wall 14 in the side walls 16, 18. Furthermore, in this embodiment, no notches 42 and reinforcement layers 22, 24 are provided. Accordingly, also in this embodiment, the diffusion resistance is provided or ensured by the outer wall 14 and parts of the side walls 16, 18 both made of (the second) synthetic material with sheet silicate.

In this embodiment, the diffusion barrier portion 34 is smaller than in the second embodiment such that a certain amount of sheet silicate may be saved.

Figure 7:
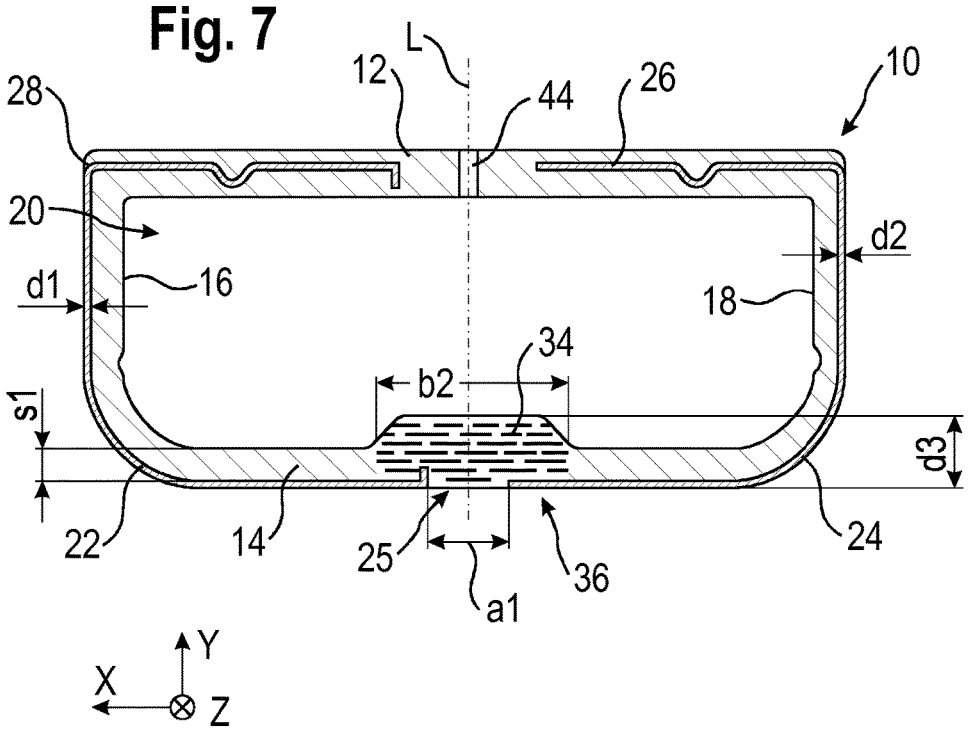

FIG. 7 shows a spacer profile 1 according to a fourth or rather fifth embodiment in a U-configuration. The fourth embodiment is shown in FIG. 7 on the left side with respect to the plane of symmetry L, and the fifth embodiment is shown in FIG. 7 on the right side with respect to the plane of symmetry L.

The fourth and fifth embodiments basically correspond to the first embodiment. In both embodiments, the diffusion barrier portion 34 is formed centrally between the side walls 16, 18 over the second width b2 in the lateral direction X and has a third thickness d3 in the height direction Y. In the fourth and fifth embodiments, the third thickness d3 is larger than the first wall thickness s1 of the outer wall 14. Accordingly, the diffusion resistance or diffusion impermeability of the diffusion barrier portion 34 may be increased.

Furthermore, in the central portion 25 or rather in the diffusion barrier portion 34, the edge of the first reinforcement layer 22 in the lateral direction X on the outer wall 14 facing the second side wall 18 is angled toward the chamber 20, in the fourth embodiment (left side). Furthermore, also the extension portion 26 in the inner wall 12 is angled toward the chamber 20 at the edge of the first reinforcement layer 22 facing the second side wall 18. The second reinforcement layer 24 is formed symmetrically to the first reinforcement layer 22, although not shown in FIG. 7, in the fourth embodiment.

In the fifth embodiment, the reinforcement layers 22, 24 do not have angled edges. Due to the angled edges, the stiffness or rather rigidity and the diffusion resistance of the spacer profile 1 according to the fourth embodiment are higher than these of the spacer profile 1 according to the fifth embodiment.

Furthermore, in both embodiments, the inner wall 12 comprises openings 44 located centrally with respect to the lateral direction X, the openings 44 being formed in the inner wall 12 by perforation. Forming of the openings 44 by perforation allows a quick and cheap manufacturing process.

Figure 8:
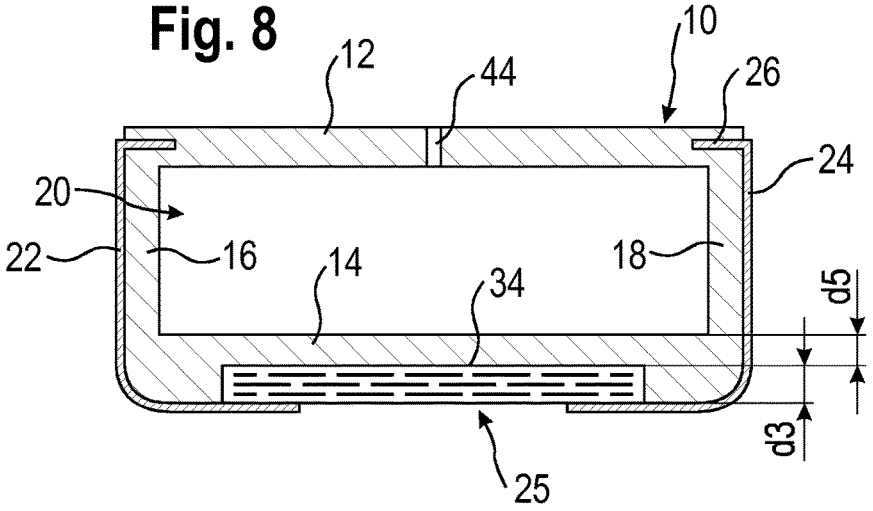
Figure 9:
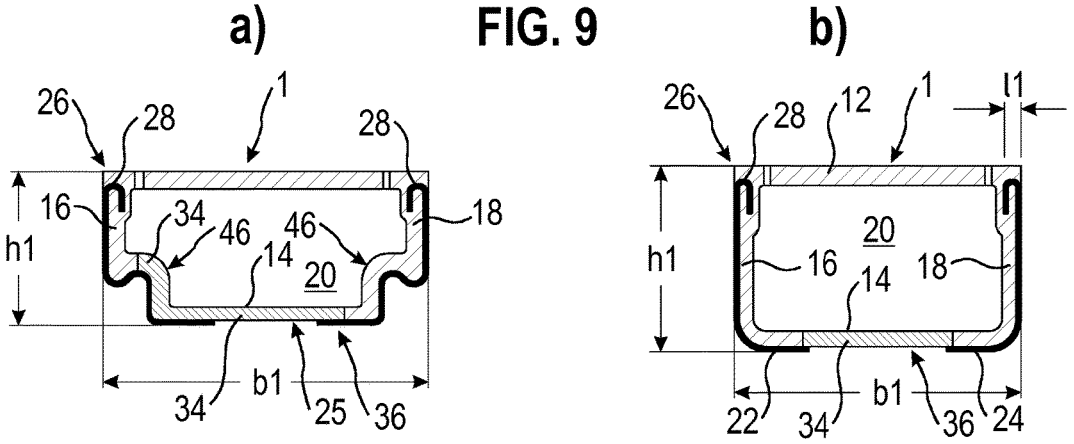
Figure 10:
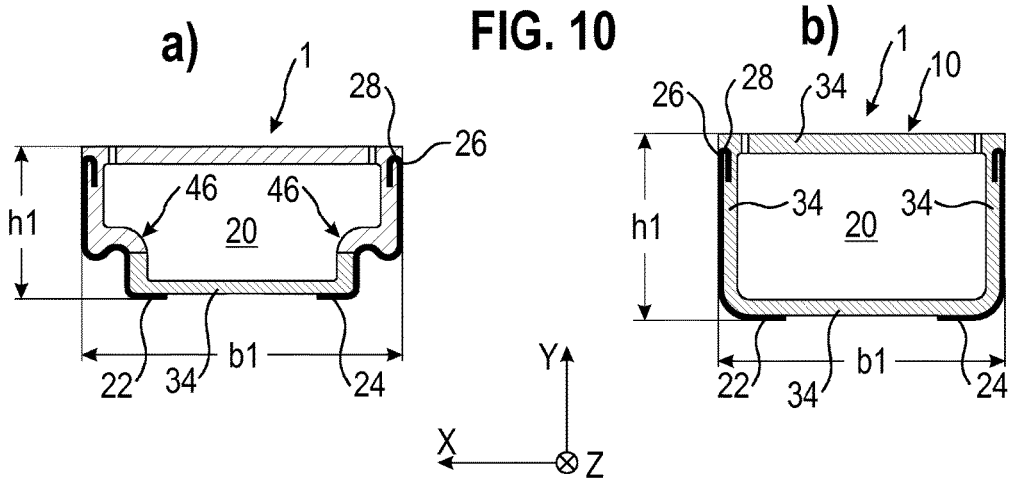
Figure 11:
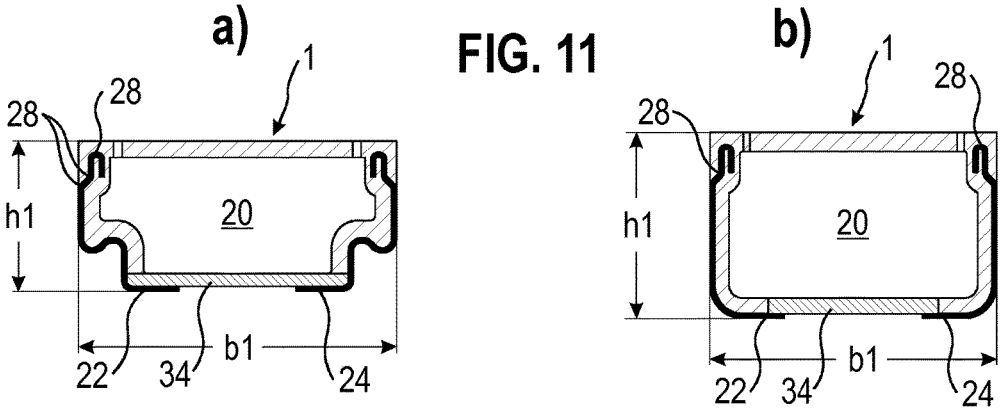

FIG. 8 shows a schematically view of a sixth embodiment. The sixth embodiment differs from the first embodiment in that no notches 42, no curvatures 21, 121, and no grooves 30 are provided. Furthermore, the diffusion barrier portion 34 is not formed over the entire thickness sl of the outer wall 14 in the height direction Y but extends in the height direction Y with a third thickness d3 being smaller than the thickness s1 of the outer wall 14, in this embodiment. Accordingly, the diffusion barrier portion 34 is embedded in the outer side of the outer wall 14 facing away from the chamber 20. Therefore, over the width of the diffusion barrier portion 34, the outer wall 14 is made of the second synthetic material with sheet silicate (diffusion barrier portion) as well as of the first synthetic material. In this portion of the outer wall, the first synthetic material has a fifth thickness d5=s1−d3.

The below described seventh to twelfth embodiments comprise a diffusion resistant or rather impermeable diffusion barrier 36 constituted by the first reinforcement layer 22, the diffusion barrier portion 34 and the second reinforcement layer 24, respectively.

FIGS. 9*a*) and *b*) show cross-sectional views of a spacer profile 1 according to a seventh and an eighth embodiment. In the seventh embodiment, the diffusion barrier portion 34 is formed unsymmetrically or rather asymmetrical. The diffusion barrier portion 34 extends over the entire outer wall 14 into the connection portion 46 between the first side wall 16 and the outer wall 14. On the opposite side in the lateral direction X, the diffusion barrier portion 34 does not extend into the connection portion 46 between the second side wall 18 and the outer wall 14. Furthermore, the spacer profiles 1 according to the seventh and eighth embodiments comprise reinforcement layers 22, 24 having extension portions 26. The extension portions 26 respectively have a 180° bend such that the bend-adjacent portion of the extension portion 26 extends in the height direction Y. Therefore, a three-sided enclosure of a part of the material of the hollow profile body 10 is achieved although only one bend 28 is present. This leads to improved bending and rigidity characteristics.

Furthermore, due to reinforcement layers 22, 24 following the concave connection portions 46, the rigidity and/or bending characteristics may be improved.

In FIGS. 10*a*) and *b*), cross-sectional views of a spacer profile 1 according to a ninth embodiment in a W-configuration and according to a tenth embodiment in a U-configuration are shown, respectively. The ninth embodiment differs from the seventh embodiment only in that the radius of the curvature of the bend of the extension portion 26 is smaller than in the seventh embodiment, and in that the diffusion barrier portion 34 extends on both sides up to the connection portions 46. In the tenth embodiment, the entire hollow profile body 10 is formed as a diffusion barrier portion 34 and the radius of curvature of the extension portions 26 is smaller than in the eighth embodiment.

In FIGS. 11*a*) and *b*), cross-sectional views of a spacer profile 1 according to an eleventh and a twelfth embodiment are shown, respectively. The eleventh and twelfth embodiments differ from the other embodiments in that the extension portions 26 comprise first a bend of about 45° towards the interior, then a bend about 45° in the opposite direction, and finally a 180° bend having a corresponding three-sided embedding of a part of the material of the hollow profile body 10. Furthermore, the diffusion barrier portion 34 is formed in the outer walls 14, only.

If the extension portions 26 have a bent, angled and/or folded configuration as explained above, the length (in the cross-section perpendicular to the longitudinal direction) of the extension portion 26, and thus the mass of the reinforcement layer 22, 24 additionally introduced in this region or area of the spacer profile 1, can significantly be increased (see FIGS. 3, 7 to 11). This results in a reduction of wrinkle formation in the bending process due to a displacement of the bend line. Furthermore, a sag of the mounted spacer frame 50 consisting of the spacer profile 1 may be reduced substantially, because the bent, angled and/or folded extension portion 26 significantly improves the structural integrity or structural stability of the bent spacer frame 50.

The features of the different embodiments may be combined with each other. The diffusion barrier portion 34 may be formed as a part or portion of arbitrary sections or portions of the walls of the hollow profile body 1, as long as a continuous diffusion barrier 36, which is diffusion resistant with respect to the intervening space 53 of the panes, is provided.

If reinforcement layers 22, 24 are present, an overlapping of the diffusion barrier portion 34 and the reinforcement layers 22, 24 may not necessarily required as long as not too much molecules can diffuse at the respective edges. For example, this may be achieved by providing reinforcement layers 22, 24 having edges being angled towards the diffusion barrier portion 34 in the diffusion barrier portion 34. Therefore, the overlapping may be omitted on one or on both sides or may be formed unsymmetrically.

The third thickness d3 of the diffusion barrier portion 34 may arbitrarily vary as long as the required diffusion resistance is achieved. The embodiment shown in FIG. 7 may be modified such that the outer wall has a constant wall thickness s1 over the lateral direction X and the "reinforcement" with the thickness d3−s1 is formed as the diffusion barrier portion 34, only. In such an amended embodiment, the diffusion barrier portion 34 may be integrally formed by co-extrusion on the side/surface of the outer wall 14 located inwardly with respect to the chamber 20.

The sheet silicate or rather the sheet silicate lamellas 38 may be oriented and arranged in the synthetic material such that a particularly good bending characteristic and rigidity of the spacer profile is achieved. In particular, by purposefully arranging the sheet silicate lamellas 38 in the synthetic material, a spacer profile may be formed, wherein a reinforcement layer can be omitted completely corresponding to the second and third embodiment, while at the same time the diffusion resistance is not changed and the bending characteristics are improved.

Likewise, by purposefully arranging the sheet silicate lamellas 38, the bending characteristic of the spacer profile 1 may be influenced such that the curvatures 21, 121 or rather the notches 42, as, for example, shown in FIG. 3, are superfluous. The outer wall 14 and/or the inner wall 12 may be formed such that they do not retract in the direction of the neutral fibre, as mentioned above.

Furthermore, the reinforcement layers 22, 24, as shown in the first to twelfth embodiments, may be formed symmetrically to each other with respect to the plane of symmetry L. The first reinforcement layer 22 may have a thickness different to the second reinforcement layer 24, or rather may be made of a different material. The first or second reinforcement layer 22, 24 may comprise an extension portion 26 while the corresponding other reinforcement layer 22, 24 does not have an extension portion 26. The reinforcement layers 22, 24 may extend on the side walls 16, 18, only, and the diffusion barrier portion 34 may extend over the entire outer wall 14 to connect the reinforcement layers 22, 24. The reinforcement layers 22, 24 optionally extend partly in the side walls 16, 18 or rather in the outer wall 14 but are always connected to the diffusion barrier portion 34.

The first or second reinforcement layers 22, 24 may extend over the larger portion or area of the outer wall than the corresponding other reinforcement layer 22, 24. That means, the distance of the central portion 25 to the first side wall 16 may be larger than the distance to the second side wall 18 and vice versa.

The central portion 25 is not necessarily arranged centrally between the side walls 16, 18. By arranging the central portion 25 not centrally, the heat conduction through the spacer profile 1 may be decreased. In particular, the heat conduction is decreased if the central portion 25 is located closer to the "warm", i.e. inner pane.

Alternatively to co-extruding the reinforcement layers 22, 24 together with the hollow profile body 10, the reinforcement layers 22, 24 may be applied directly on the hollow profile body 10 after extruding the hollow profile body 10, for example, by an adhesion agent or glue. Further, the portion on the hollow profile body 10 intended for (receiving) the reinforcement layers 22, 24 may be formed such that no breaks are provided at the edges and transitions between the corresponding parts after applying the reinforcement layers 22, 24. That means, the portions, on which, for example, the reinforcement layers 22, 24 are applied, are already formed as recesses in the hollow profile body 10 when extruding the hollow profile body 10. Accordingly, the reinforcement layers 22, 24 may be inserted into theses recesses.

Furthermore, the diffusion barrier portion 34 and the hollow profile body 10 may be connected after the extrusion process.

The hollow profile body 10 may have the shape of a trapezoid, quadrate, rhombus, or any other body. The concave connection portions 46 may be shaped different, for example, double bulged, asymmetrically bulged, etc. In particular, the spacer profile 1 may be formed such that the side walls 16, 18 are not the outermost walls in the lateral direction X intended to contact the panes. Such an embodiment may be formed, for example, as follows: the spacer profile 1 may comprise an inner wall 12 being broader with respect to the outer wall 14. The side walls 16, 18 may be not connected with the edges of the inner wall 12 in the lateral direction X but may be arranged offset or displaced by a small distance inwardly in the lateral direction X. The outer wall 14, which is connected to the side walls 16, 18, the side walls 16, 18, and the inner wall 12 may constitute the chamber 20. Additionally, at the edges of the inner wall 12 in the lateral direction X, two further outer (side) walls extending parallel to the side walls 16, 18 may be provided, the additional outer (side) walls serving as a contact surface for the panes. In such an embodiment, the reinforcement layers 22, 24 may be formed completely or partly in or on the additional outer walls, the side walls 16, 18, and the inner wall 12.

The wall thicknesses s1, s2 of the side walls 16, 18 and/or of the outer wall 14 may be different to each other. The openings 44 may be formed asymmetrically to the plane of symmetry L or only centrally or only on one side with respect to the lateral direction X. The openings 44 may be arranged uniformly or erratically in the longitudinal direction Z. With respect to the lateral direction X, the openings 44 may be arranged in a single row or in a plurality of rows in the longitudinal direction with respect to the lateral direction X.

In or on the inner wall 12, at least partly a further reinforcement layer made of metal material may be provided. The extension portions 26 may be arbitrarily formed, angled etc. or rather unsymmetrical to each other. The chamber 20 may be divided into a plurality of chambers by dividing walls. The cross-section of the reinforcement layers 22, 24 does not necessarily have to be constant but may have a profiled form such that the connection between the reinforcement layers 22, 24 and the hollow profile body 10 is further improved. Furthermore, knobs and grooves may be provided.

The first height h1 of the hollow profile body 10 in the height direction Y is preferably between 10 mm and 5 mm, more preferably between 8 mm and 6 mm, for example 6.85 mm, 7 mm, 7.5 mm or, 8 mm.

The second height h2 of the curvature 21 in the height direction Y is preferably between 2 mm and 0,05 mm, more preferably between 1 mm and 0,1 mm, for example 0,5 mm, 0,8 mm, or 1 mm.

The third height h3 of the curvature 121 in the height direction Y is preferably between 2 mm and 0,05 mm, more preferably between 1 mm and 0,05 mm, still more preferably between 0,5 mm and 0,05 mm, for example 0,1 mm, 0.12 mm, or 0,15 mm.

The first width b1 of the hollow profile body 10 in the lateral direction X is preferably between 40 mm and 6 mm, more preferably between 25 mm and 6 mm, and still more preferably between 16 mm and 6 mm, for example 8 mm, 12 mm, or 15,45 mm.

The second width b2 of the diffusion barrier portion 34 in the lateral direction X is preferably between 10% to 100% of the first width b1, more preferably between 30% and 90% of the first width b1, for example 30% or 40%, . . . , 80%, 90% of the first width, accordingly, for example, b2=5 mm, b1=10 mm.

The third width (b2−a1)/2 of the overlapping in the lateral direction X is preferably about b1−b2, but more preferably at least 1 mm, and still more preferably between 1 mm and 10 mm, for example 2 mm, 5 mm, 8 mm, or 10 mm.

The fourth width b4 of a sheet silicate lamella 38 in the lateral direction X is on average between 20 nm and 10000 nm, for example 100 nm, 500 nm, or 5000 nm.

The first distance a1 in the lateral direction X between the reinforcement layers 22, 24 is preferably between 10% to 100% of the first width b1, more preferably between 0,9 b2 and 0,5 b2.

The second distance a2 in the lateral direction X between adjacent sheet silicate lamellas 38 is on average preferably between 0,1 nm and 200 nm, more preferably between 0,1 nm and 50 nm, for example 1 nm, 3 nm, or 50 nm.

The third distance a3 in the height direction Y between two adjacent sheet silicate lamellas 38 is on average preferably between 0,1 nm and 200 nm, more preferably between 0,1 nm and 50 nm, for example 1 nm, 3 nm, or 50 nm.

The fourth distance a4 in the longitudinal direction Z between two adjacent sheet silicate lamellas 38 is on average preferably between 0,1 nm and 200 nm, more preferably between 0,1 nm and 50 nm, for example 1 nm, 3 nm, or 50 nm.

The first thickness d1 of the first reinforcement layer 22 made of metal material is preferably between 0,5 mm and 0,01 mm, more preferably between 0,2 mm and 0,1 mm, for example 0,1 mm, 0,05 mm or 0,01 mm.

The second thickness d2 of the second reinforcement layer 24, 124 preferably corresponds to the first thickness d1.

The third thickness d3 of the diffusion barrier portion 34 made of synthetic material with sheet silicate is preferably between 2 mm and 0,1 mm, more preferably between 1,2 mm and 0,4 mm, and further more preferably between 1,2 mm and 0,6 mm, for example 0,6 mm, 1,0 mm, or 1,2 mm.

The fourth thickness d4 of a sheet silicate lamella 38 is on average preferably between 0,1 nm and 10 nm, more preferably between 0,1 nm and 5 nm, and further more preferably between 1 nm and 5 nm, as for example 1 nm, 2 nm, or 4 nm.

The first length of the extension portions 26 in the lateral direction X is preferably 0,1 b1<l1<0,4 b1, more preferably 0,2 b1<l1<0,4 b1 and further more preferably 0,2 b1<l1<0,3 b1.

The first wall thickness s1 of the side walls 16, 18 and the outer wall 14 is preferably between 1,2 mm and 0,2 mm, more preferably between 1,0 mm and 0,5 mm, for example 0,5 mm, 0,6 mm, or 0,7 mm.

The second wall thickness s2 of the inner wall 12 is preferably between 1,5 mm, 0,5 mm, for example 0,7 mm, 0,8 mm, 0,9 mm, or 1,0 mm.

The second length 12 of a sheet silicate lamella 38 in the longitudinal direction Z is on average preferably between 20 nm and 20000 nm, for example 100 nm, 500 nm or 5000 nm.

It is explicitly stated that all features disclosed in the description and/or the claims are intended to be disclosed separately and independently from each other for the purpose of original disclosure as well as for the purpose of restricting the claimed invention independent of the compositions of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

LIST OF REFERENCE SIGNS

1 spacer profile
10 hollow profile body
12 inner wall
14 outer wall
16 first side wall
18 second side wall
20 chamber
21, 121 curvature (arch, concavity)
22 first reinforcement layer
24 second reinforcement layer
25 central portion
26 extension portion (or elongation portion)
28 bend in the extension portion
30 groove in the extension portion
32 accommodation portion (retaining portion)
34 diffusion barrier portion
36 diffusion barrier
38 sheet silicate lamella (lamina, part)
40 sheet plane (atomic layer, layer plane, layer level)
42 notch
44 opening
46 connection portion
50 spacer frame
51, 52 panes (glass panes)
53 intervening space (between) panes
54 connector

The invention claimed is:

1. A spacer profile that is adapted to be used in a spacer frame of an insulating glass unit for door, window or facade elements, the insulating glass unit comprising panes having an intervening space defined between the panes, the spacer profile comprising:

a hollow profile body comprising a first synthetic material and comprising a chamber for accommodating hydroscopic material, the hollow profile body:

extending in a longitudinal direction, comprising an inner wall, which is adapted to face the intervening space between the panes of the insulating glass unit in an assembled state of the insulating glass unit, comprising an outer wall on the opposite side of the inner wall in a height direction, the height direction being perpendicular to the longitudinal direction, and comprising, in a lateral direction that is perpendicular to the longitudinal direction and the height direction, a first side wall and a second side wall on the opposite side of the first side wall wherein the inner wall and the outer wall and the first and second side walls are connected for forming the chamber, a diffusion-resistant diffusion barrier portion forms at least partly a diffusion barrier, the diffusion-resistant diffusion barrier portion comprising a second synthetic material to which sheet silicate is added and being formed as at least a part of the outer wall, and the first synthetic material does not comprise sheet silicate.

2. The spacer profile according to claim 1, wherein the outer wall is formed as the diffusion barrier portion over its entire width in the lateral direction and at least partly in the height direction.

3. The spacer profile according to claim 1, wherein the diffusion barrier portion extends in one piece at least partly in and/or on at least one of the side walls.

4. The spacer profile according to claim 1, wherein the first synthetic material is identical to the second synthetic material with sheet silicate.

5. The spacer profile according to claim 4, which does not comprise a reinforcement layer made of metal on or in the hollow profile body.

6. The spacer profile according to claim 1, comprising a first reinforcement layer comprising a first metal material and extending in the longitudinal direction in one piece on and optionally in sections in the first side wall with a constant cross section perpendicular to the longitudinal direction and a second reinforcement layer comprising a second metal material and extending in the longitudinal direction in one piece on and optionally in sections in the second side wall with a constant cross section perpendicular to the longitudinal direction, and extending spaced by a first distance from the first reinforcement layer, wherein the diffusion barrier portion extends at least over the first distance between the reinforcement layers, and the reinforcement layers and the diffusion barrier portion are connected in a diffusion resistant manner to form the diffusion barrier.

7. The spacer profile according to claim 6, wherein the first metal material of the first reinforcement layer has a first thickness and a first specific heat conductivity, the second metal material of the second reinforcement layer has a second thickness and a second specific heat conductivity, and the diffusion barrier portion comprising the second synthetic material with sheet silicate has a third thickness and a third specific heat conductivity, and the product of the third specific heat conductivity and the third thickness is smaller than the product of the first specific heat conductivity and the first thickness, and smaller than the product of the second specific heat conductivity and the second thickness.

8. The spacer profile according to claim 6, wherein the first reinforcement layer additionally extends in the longitudinal direction in one piece on and optionally in sections in the outer wall with a constant cross section perpendicular to the longitudinal direction, and the second reinforcement layer extends in the longitudinal direction in one piece on and optionally in sections in the outer wall with a constant cross section perpendicular to the longitudinal direction and spaced by the first distance from the first reinforcement layer.

9. The spacer profile according to claim 6, wherein each of the reinforcement layers comprises in a cross section perpendicular to the longitudinal direction a profiled extension portion on its edge near the inner wall.

10. An insulating glass unit comprising at least two panes that are arranged opposite to each other and spaced by a distance for providing an intervening space between the panes, and a spacer frame formed by a spacer profile according to claim 6, the spacer frame being arranged between the panes such that the outer sides of the side walls in the lateral direction are bonded to the surfaces of the panes facing the outer sides of the side walls by a diffusion resistant bonding material and such that the spacer frame defines the intervening space between the panes.

11. The spacer profile according to claim 6, wherein the side walls respectively comprise a connection portion extending from the corresponding side wall to the outer wall, the connection portion being concave with respect to the chamber.

12. The spacer profile according to claim 1, wherein the sheet silicate in the diffusion barrier portion consists of sheet silicate lamellas having flat sides that have an average surface area of 5 $\mu m^2$ to 50 $\mu m^2$, the sheet silicate lamellas constitute 5 to 30 weight percent of the diffusion barrier portion, and the flat sides of the sheet silicate lamellas are arranged substantially parallel to each other and to a first exterior surface of the outer wall and to a second exterior surface of the outer wall.

13. The spacer profile according to claim 1, wherein the side walls respectively comprise a connection portion extending from the corresponding side wall to the outer wall, the connection portion being concave with respect to the chamber.

14. An insulating glass unit comprising at least two panes that are arranged opposite to each other and spaced by a distance for providing an intervening space between the panes, and a spacer frame formed by a spacer profile according to claim 1, the spacer frame being arranged between the panes such that the outer sides of the side walls in the lateral direction are bonded to the surfaces of the panes facing the outer sides of the side walls by a diffusion resistant bonding material and such that the spacer frame defines the intervening space between the panes.

15. The spacer profile according to claim 1, wherein the diffusion barrier portion is located at least partly in a neutral fibre of the hollow profile body.

16. The spacer profile according to claim 1, wherein the spacer profile fulfils test norm EN 1279 part 2+3 for diffusion resistance.

17. The spacer profile according to claim 1, wherein the sheet silicate comprises sheet silicate lamellas arranged in the outer wall substantially parallel to each other and to the outer wall.

18. A spacer profile for a spacer frame of an insulating glass unit for door, window or facade elements, the insulating glass unit comprising panes having an intervening space between the panes, the spacer profile comprising a hollow profile body formed from a synthetic material and extending in a longitudinal direction and having a height direction perpendicular to the longitudinal direction and a lateral direction perpendicular to both the longitudinal direction and the height direction, the hollow profile body comprising:

an inner wall configured to face the intervening space between the panes of the insulating glass unit in an assembled state of the insulating glass unit, an outer wall spaced from the inner wall in the height direction, the outer wall having a first exterior surface facing toward the inner wall, a second exterior surface facing away from the inner wall and an interior body of material inward of the first exterior surface and inward of the second exterior surface, a first side wall, a second side wall spaced from the first side wall in the lateral direction, the first side wall and the second side wall connecting the inner wall to the outer wall, wherein the inner wall, the outer wall, the first side wall and the second side wall define a chamber for accommodating a hydroscopic material, and a diffusion barrier comprising sheet silicate embedded in only a portion of the interior body of the outer wall, said portion having a dimension in the lateral direction that is less than a total dimension of the outer wall in the lateral direction.

19. The spacer profile according to claim 18, further comprising a first one-piece metal reinforcement layer extending in the longitudinal direction along the first side wall, the first reinforcement layer having a constant cross section in the lateral direction and a second one-piece metal reinforcement layer extending in the longitudinal direction along the second side wall, the second reinforcement layer having a constant cross section in the lateral direction, and being spaced from the first reinforcement layer on the outer wall by a gap, wherein the diffusion barrier spans the gap to form a continuous diffusion barrier with the first metal reinforcement layer and the second metal reinforcement layer along the outer wall.

20. The spacer profile according to claim 18, wherein no sheet silicate is located in the first side wall or in the second side wall.

21. The spacer profile according to claim 18, wherein the sheet silicate comprises sheet silicate lamellas in the portion of the interior body, the sheet silicate lamellas being arranged substantially parallel to each other and to the first and second exterior surfaces of the outer wall.

22. The spacer profile according to claim 18, wherein the diffusion barrier is located at least partly in a neutral fibre of the hollow profile body.

23. The spacer profile according to claim 18, wherein the sheet silicate in the diffusion barrier consists of sheet silicate lamellas having flat sides that have an average surface area of 1 $\mu m^2$ to 50 $\mu m^2$, the sheet silicate lamellas constitute 5 to 30 weight percent of the diffusion barrier portion, and the flat sides of the sheet silicate lamellas are arranged substantially parallel to each other and to the first and second exterior surfaces of the outer wall.

24. A spacer profile for use in a spacer frame of an insulating glass unit for door, window or facade elements, the insulating glass unit comprising panes spaced apart by an intervening space, the spacer profile comprising:

a hollow profile body extending in a longitudinal direction, the hollow profile body having an inner wall, an outer wall disposed opposite of the inner wall in a height direction that is perpendicular to the longitudinal direction, and first and second side walls respectively connecting the inner wall to the outer wall in the height direction such that an inner chamber is defined by the inner wall, the outer wall and the first and second side walls, wherein the inner wall is configured to face the intervening space between the panes of the insulating glass unit in an assembled state of the insulating glass unit, the inner wall and at least portions of the first and second side walls connected to the inner wall comprise a first elastic-plastic deformable material that does not contain sheet silicate, and at least a portion of the outer wall is composed of a diffusion-resistant barrier portion comprising a second elastic-plastic deformable material that contains sheet silicate.

25. The spacer profile according to claim 24, further comprising:

a first metal reinforcement layer covering at least a portion of the first side wall and at least a first portion of the outer wall that is adjacent to the first side wall, and a second metal reinforcement layer covering at least a portion of the second side wall and at least a second portion of the outer wall that is adjacent to the second side wall, wherein at least a central portion of the outer wall in a lateral direction that is perpendicular to the longitudinal direction and to the height direction is not covered by the first metal reinforcement layer or second metal reinforcement layer such that a gap exists between the first and second metal reinforcement layers in the lateral direction, and the diffusion-resistant barrier portion extends in the lateral direction along a width of the outer wall that is at least as wide as the gap between the first and second metal reinforcement layers.

26. The spacer profile according to claim 25, wherein the first and second elastic-plastic deformable materials comprise at least one polymer selected from the group consisting of a polyolefin, a polyethylene terephthalate, a polyamide and a polycarbonate.

27. An insulating glass unit comprising:

at least two panes, and a spacer frame formed by the spacer profile according to claim 26, the spacer frame being arranged between the panes such that outer sides of the first and second side walls in the lateral direction are bonded to surfaces of the panes facing the outer sides of the side walls by a diffusion resistant bonding material and such that the spacer frame defines a width of the intervening space between the panes in the lateral direction.

* * * * *